US010364782B2

(12) United States Patent
Takase

(10) Patent No.: US 10,364,782 B2
(45) Date of Patent: Jul. 30, 2019

(54) FUEL INJECTION DEVICE FOR AN INTERNAL COMBUSTION ENGINE

(71) Applicant: TOYOTA JIDOSHA KABUSHIKI KAISHA, Toyota-shi, Aichi (JP)

(72) Inventor: Kohei Takase, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 308 days.

(21) Appl. No.: 15/461,640

(22) Filed: Mar. 17, 2017

(65) Prior Publication Data

US 2017/0276108 A1 Sep. 28, 2017

(30) Foreign Application Priority Data

Mar. 23, 2016 (JP) ..... 2016-058874

(51) Int. Cl.

| | |
|---|---|
| ***F02M 55/02*** | (2006.01) |
| ***F02M 63/02*** | (2006.01) |
| ***F02M 61/04*** | (2006.01) |
| *F02B 75/20* | (2006.01) |
| *F02B 75/22* | (2006.01) |
| *F02B 75/18* | (2006.01) |

(52) U.S. Cl.

CPC ..... *F02M 55/02* (2013.01); *F02M 61/04* (2013.01); *F02M 63/0225* (2013.01); *F02M 63/0285* (2013.01); *F02B 75/20* (2013.01); *F02B 75/22* (2013.01); *F02B 2075/1816* (2013.01); *F02B 2075/1824* (2013.01)

(58) Field of Classification Search

CPC ..... F02M 55/02; F02M 55/025; F02M 61/04; F02M 63/0225; F02M 63/0285

See application file for complete search history.

(56) References Cited

U.S. PATENT DOCUMENTS

2014/0283790 A1* 9/2014 Suzuki ..... F02M 63/0275 123/456

2015/0369185 A1 12/2015 Takahata et al.

FOREIGN PATENT DOCUMENTS

| | | |
|---|---|---|
| JP | 54-74912 A | 6/1979 |
| JP | 2006-63983 | 3/2006 |
| JP | 2007-182792 | 7/2007 |
| JP | 2014-156799 | 8/2014 |
| WO | WO 2011/085858 A1 | 7/2011 |

* cited by examiner

*Primary Examiner* — Jacob M Amick

(74) *Attorney, Agent, or Firm* — Finnegan, Henderson, Farabow, Garrett & Dunner, LLP

(57) ABSTRACT

A common-rail fuel injection device for an internal combustion engine, including fuel injection valves each having two fuel supply ports, is known as a fuel injection device for suppressing temporary decrease of a fuel pressure immediately after the end of fuel injection from the fuel injection valve. Even in this fuel injection device, the fuel injection pressure may fluctuate immediately after the end of fuel injection, thereby causing changes of amount and particle diameter of injected fuel. A common rail is connected to one fuel supply port of the fuel injection valve, whereas another fuel injection valve, which is non-contiguous in the order of combustions, is connected to the other fuel supply port by an injection-valve connection pipe.

7 Claims, 10 Drawing Sheets

<FOURTH EMBODIMENT>

50

<FIFTH EMBODIMENT>

FUEL INJECTION DEVICE FOR AN INTERNAL COMBUSTION ENGINE

BACKGROUND OF THE INVENTION

1. Field of the Invention

The present invention relates to a common-rail fuel injection device for an internal combustion engine.

2. Description of the Related Art

A common-rail fuel injection device is known as a fuel injection device for an internal combustion engine (hereinafter also referred to simply as "engine"). In the common rail system, fuel pressurized by a fuel supply pump (supply pump) is accumulated in a common rail. The pressurized fuel is supplied from the common rail to fuel injection valves through fuel supply pipes (fuel injection pipes).

Thus, at the time of fuel injection from the fuel injection valve, the fuel injection pressure of the fuel to be injected into each cylinder (combustion chamber) is increased so that the particle diameter of the fuel injected into the cylinder is reduced. As a result, the vaporization or atomization rate of the fuel injected into the combustion chamber is increased so that complete combustion is promoted, thereby reducing unburned substances contained in exhaust gas (such as hydrocarbon and carbon monoxide).

In addition, the volume of the fuel accumulated in the common rail under the pressurized state is relatively large, and hence the decrease amount of the "pressure of the fuel supplied to the fuel injection valve (injection-valve fuel pressure)" is small immediately after the end of fuel injection. Therefore, the fuel injection can be repeated within a short period of time, thereby being capable of achieving multi-stage injection for injecting the fuel into a single cylinder a plurality of times in one cycle (sequential fuel injection involving pre-injection, main injection, after-injection, and post-injection).

Even in the common-rail fuel injection device, however, the injection-valve fuel pressure is temporarily decreased to some extent when the fuel is injected. As a result, when further fuel injection is performed immediately after the end of fuel injection (for example, when second pre-injection is performed after first pre-injection), the actual fuel injection amount may become smaller than the expected fuel injection amount. In addition, the particle diameter of the injected fuel may become larger.

In view of the above, one of the related-art common-rail fuel injection devices (hereinafter also referred to as "related-art device") is applied to an engine including four cylinders, and includes four fuel injection valves each having two fuel supply ports and being arranged for a corresponding one of the cylinders.

In this related-art device, one of the two fuel supply ports of the first fuel injection valve is directly connected to a common rail through a fuel supply pipe, whereas the other one of the fuel supply ports of the first fuel injection valve is directly connected to one of the two fuel supply ports of the second fuel injection valve through an injection-valve connection pipe. The other one of the fuel supply ports of the second fuel injection valve is directly connected to one of the two fuel supply ports of the third fuel injection valve through an injection-valve connection pipe. The other one of the fuel supply ports of the third fuel injection valve is directly connected to one of the two fuel supply ports of the fourth fuel injection valve through an injection-valve connection pipe. The other one of the fuel supply ports of the fourth fuel injection valve is directly connected to the common rail through a fuel supply pipe. Thus, each fuel injection valve injects the fuel supplied through the two fuel supply ports into the cylinder (see, for example, International Patent WO2011/085858A).

According to the related-art device, the pressurized fuel is supplied to each fuel injection valve through the two fuel supply ports of each fuel injection valve, thereby being capable of reducing the magnitude of the decrease amount of the fuel injection pressure (injection-valve fuel pressure) immediately after the end of fuel injection as compared to a case where the fuel injection valve has one fuel supply port alone.

Even in the related-art device, however, the injection-valve fuel pressure is decreased to some extent immediately after the end of fuel injection, and is increased afterwards. As a result, the injection-valve fuel pressure fluctuates over time. The fluctuation of the injection-valve fuel pressure (hereinafter also referred to simply as "fuel pressure fluctuation") propagates to another fuel injection valve through the fuel in the injection-valve connection pipe. As a result, the amount of fuel injected in actuality may become significantly different from the expected amount of fuel, or the particle diameter of the injected fuel may become larger.

Now, the above-mentioned fuel pressure fluctuation and its influence are further described with reference to an example of the related-art device having a schematic configuration illustrated in FIG. 9.

The related-art device of FIG. 9 includes a common rail 91 and a first fuel injection valve 92*a* to a fourth fuel injection valve 92*d*. The common rail 91 and the first fuel injection valve 92*a* are connected by a first fuel supply pipe 93*a*. The common rail 91 and the fourth fuel injection valve 92*d* are connected by a second fuel supply pipe 93*b*.

The first fuel injection valve 92*a* and the second fuel injection valve 92*b* are connected by a first injection-valve connection pipe 94*e*. The second fuel injection valve 92*b* and the third fuel injection valve 92*c* are connected by a second injection-valve connection pipe 94*b*. The third fuel injection valve 92*c* and the fourth fuel injection valve 92*d* are connected by a third injection-valve connection pipe 94*c*.

FIG. 4 is a graph for showing results of measurement conducted by the inventors of the present invention on "how the fuel pressure fluctuation caused by the fuel injection from the second fuel injection valve 92*b* propagates to the first fuel injection valve 92*a*" when the fuel injection is performed in an order of the first fuel injection valve 92*a*, the third fuel injection valve 92*c*, the fourth fuel injection valve 92*d*, and the second fuel injection valve 92*b*.

The solid line Lp1 of FIG. 4 indicates a change of the injection-valve fuel pressure of the second fuel injection valve 92*b* at the time of performing fuel injection from the second fuel injection valve 92*b*. The solid line Lp2 of FIG. 4 indicates a change of the injection-valve fuel pressure of the first fuel injection valve 92*a* at that time. As understood from the ellipse Ce1 to the ellipse Ce4 of FIG. 4, the injection-valve fuel pressure of the first fuel injection valve 92*a* fluctuates along with the fuel injection from the second fuel injection valve 92*b*.

Therefore, for example, when the timing of post-injection from the second fuel injection valve 92*b* and the timing of main injection from the first fuel injection valve 92*a* are close to each other (see FIG. 2), the amount of fuel injected from the first fuel injection valve 92*a* in actuality may become significantly different from the expected amount of fuel. Further, when the fuel is injected from the first fuel injection valve 92*a* at a low injection-valve fuel pressure of the first fuel injection valve 92*a* (that is, at a trough of the fuel pressure fluctuation), the particle diameter of the injected fuel may become larger.

SUMMARY OF THE INVENTION

The present invention has been made to solve the above-mentioned problems, and it is therefore one of objects of the present invention to provide a fuel injection device for an internal combustion engine, which is capable of suppressing influence of a fuel pressure fluctuation caused along with fuel injection from a certain fuel injection valve on "fuel injection from another fuel injection valve connected to the fuel injection valve by an injection-valve connection pipe".

A fuel injection device for an internal combustion engine according to the present invention for achieving the above-described object (hereinafter also referred to as "device of the present invention") is applied to a multi-cylinder internal combustion engine with an even number of cylinders including four or more cylinders, the fuel injection device including: a common rail (14) to which pressurized fuel is to be supplied; a plurality of fuel injection valves (11*a* to 11*d*); a plurality of fuel supply pipes (12*a* to 12*d*); and a plurality of injection-valve connection pipes (13*a* and 13*b*).

Each of the plurality of fuel injection valves has a first supply port (15*a* to 15*d*) and a second supply port (16*a* to 16*d*) that communicates to the first supply port, and is configured to inject the pressurized fuel, which is supplied to each of the first supply port and the second supply port, to a corresponding one of the even number of cylinders.

Each of the plurality of fuel supply pipes directly connects the first supply port of the each of the plurality of fuel injection valves and the common rail.

Each of the plurality of injection-valve connection pipes directly connects the second supply ports of a pair of the plurality of fuel injection valves provided to a pair of the cylinders, which are non-contiguous in an order of combustions.

The description "directly connects" herein means that no other fuel injection valve is interposed. Thus, an orifice may be interposed at the end of each of the fuel supply pipe and the injection-valve connection pipe and/or at a portion other than the end.

When a combustion order has arrived for a cylinder to which a certain fuel injection valve (fuel injection valve A) is provided so that fuel injection from the fuel injection valve A is performed, the fuel pressure fluctuates in the fuel injection valve A. The fuel pressure fluctuation propagates to another fuel injection valve (fuel injection valve B) connected to the fuel injection valve A by the injection-valve connection pipe.

The cylinder to which the fuel injection valve A is provided and the cylinder to which the fuel injection valve B is provided are non-contiguous in the order of combustions, and hence the cylinder whose combustion is performed after the fuel injection from the fuel injection valve A is a cylinder to which a fuel injection valve other than the fuel injection valve A and the fuel injection valve B is provided. In other words, a certain length of time is taken since the end of fuel injection from the fuel injection valve A until the start of fuel injection from the fuel injection valve B.

Therefore, at the timing of the combustion for the cylinder to which the fuel injection valve B is provided, the fuel pressure fluctuation caused by the fuel injection from the fuel injection valve A is mitigated. Thus, according to the device of the present invention, it is possible to suppress the influence of the fuel pressure fluctuation caused along with the fuel injection from a certain fuel injection valve on the fuel injection from another fuel injection valve connected to the fuel injection valve by the injection-valve connection pipe.

In one embodiment of the present invention, channel sectional areas and lengths of the plurality of fuel supply pipes are equal to each other, and channel sectional areas and lengths of the plurality of injection-valve connection pipes are equal to each other.

The fuel pressure fluctuation caused along with the fuel injection corresponds to a compressional wave, which propagates through each of the fuel in the fuel supply pipe and the fuel in the injection-valve connection pipe as a medium. Further, the compressional wave is reflected at, for example, the end of the fuel supply pipe (connection portion between the fuel supply pipe and the common rail) and the end of the injection-valve connection pipe (connection portion between the injection-valve connection pipe and the fuel injection valve).

Thus, when the channel sectional areas and/or the lengths of the fuel supply pipes and/or the injection-valve connection pipes vary, characteristics of the fuel pressure fluctuations (waveforms indicating changes of the injection-valve fuel pressures with respect to time) vary as well. For example, FIG. 10 is a graph for showing results of measurement conducted by the inventors of the present invention on changes of the injection-valve fuel pressures after the fuel injection from the first fuel injection valve 92*a* to the fourth fuel injection valve 92*d* of the above-mentioned related-art device illustrated in FIG. 9.

In FIG. 10, the crank angle of each cylinder is adjusted so that compression top dead centers of the cylinders to which the first fuel injection valve 92*a* to the fourth fuel injection valve 92*d* are provided, respectively, coincide with each other (the adjusted crank angle is also referred to as "reference crank angle" for convenience). As a result, in FIG. 10, the first fuel injection valve 92*a* to the fourth fuel injection valve 92*d* start the fuel injection at the same crank angle (crank angle CAa), and finish the fuel injection at the same crank angle (crank angle CAb). As understood from the ellipse Ce5 of FIG. 10, the characteristics of the fuel pressure fluctuations of the first fuel injection valve 92*a* to the fourth fuel injection valve 92*d* are significantly different from each other.

Meanwhile, in the embodiment of the present invention, the channel sectional areas and the lengths of the plurality of fuel supply pipes are equal to each other, and the channel sectional areas and the lengths of the plurality of injection-valve connection pipes are equal to each other. Thus, as shown in the graph of FIG. 3 similar to that of FIG. 10, the characteristics of the fuel pressure fluctuations of the plurality of fuel injection valves are similar to each other.

For example, under the similar characteristics of the fuel pressure fluctuations, at the time of performing multi-stage injection, in which further fuel injection (second-stage injection) is performed after the fuel injection (first-stage injection), a map for predicting the amount of the change of the injection-valve fuel pressure at the injection timing of second-stage injection based on "an injection period of the first-stage injection, a period from the first-stage injection to the second-stage injection, an injection-valve fuel pressure at the time of first-stage injection, and other parameters" can be shared among all the fuel injection valves. Thus, according to the embodiment of the present invention, there is no need to adapt the maps to the respective fuel injection valves, thereby being capable of reducing the number of adaptation steps.

The device of the present invention may be applied to an in-line four-cylinder engine constructed such that a first cylinder, a second cylinder, a third cylinder, and a fourth cylinder are arrayed in line in the stated order, and that the combustions are performed in an order of the first cylinder, the third cylinder, the fourth cylinder, and the second cylinder, in which the plurality of fuel injection valves include:

a first fuel injection valve (11*a*) provided to the first cylinder;

a second fuel injection valve (11*b*) provided to the second cylinder;

a third fuel injection valve (11*c*) provided to the third cylinder; and a fourth fuel injection valve (11*d*) provided to the fourth cylinder, and in which the plurality of injection-valve connection pipes include:

a first connection pipe (13*a*) directly connecting the second supply port (16*a*) of the first fuel injection valve and the second supply port (16*d*) of the fourth fuel injection valve; and a second connection pipe (13*b*) directly connecting the second supply port (16*b*) of the second fuel injection valve and the second supply port (16*c*) of the third fuel injection valve.

Alternatively, the device of the present invention may be applied to an in-line six-cylinder engine constructed such that a first cylinder, a second cylinder, a third cylinder, a fourth cylinder, a fifth cylinder, and a sixth cylinder are arrayed in line in the stated order, and that the combustions are performed in an order of the first cylinder, the fifth cylinder, the third cylinder, the sixth cylinder, the second cylinder, and the fourth cylinder, in which the plurality of fuel injection valves include:

a first fuel injection valve (31*a*) provided to the first cylinder;

a second fuel injection valve (31*b*) provided to the second cylinder;

a third fuel injection valve (31*c*) provided to the third cylinder;

a fourth fuel injection valve (31*d*) provided to the fourth cylinder;

a fifth fuel injection valve (31*e*) provided to the fifth cylinder; and a sixth fuel injection valve (31*f*) provided to the sixth cylinder, and in which the plurality of injection-valve connection pipes include:

a first connection pipe (33*a*) directly connecting the second supply port (36*a*) of the first fuel injection valve and the second supply port (36*f*) of the sixth fuel injection valve;

a second connection pipe (33*b*) directly connecting the second supply port (36*b*) of the second fuel injection valve and the second supply port (36*e*) of the fifth fuel injection valve; and a third connection pipe (33*c*) directly connecting the second supply port (36*c*) of the third fuel injection valve and the second supply port (36*d*) of the fourth fuel injection valve.

Alternatively, the device of the present invention may be applied to an in-line six-cylinder engine constructed such that a first cylinder, a second cylinder, a third cylinder, a fourth cylinder, a fifth cylinder, and a sixth cylinder are arrayed in line in the stated order, and that the combustions are performed in an order of the first cylinder, the fourth cylinder, the second cylinder, the third cylinder, the sixth cylinder, and the fifth cylinder, in which the plurality of fuel injection valves include:

a first fuel injection valve (31*a*) provided to the first cylinder;

a second fuel injection valve (31*b*) provided to the second cylinder;

a third fuel injection valve (31*c*) provided to the third cylinder;

a fourth fuel injection valve (31*d*) provided to the fourth cylinder;

a fifth fuel injection valve (31*e*) provided to the fifth cylinder; and a sixth fuel injection valve (31*f*) provided to the sixth cylinder, and in which the plurality of injection-valve connection pipes include:

a first connection pipe (43*a*) directly connecting the second supply port (36*a*) of the first fuel injection valve and the second supply port of (36*c*) the third fuel injection valve;

a second connection pipe (43*b*) directly connecting the second supply port (36*b*) of the second fuel injection valve and the second supply port (36*e*) of the fifth fuel injection valve; and a third connection pipe (43*c*) directly connecting the second supply port (36*d*) of the fourth fuel injection valve and the second supply port (36*f*) of the sixth fuel injection valve.

Alternatively, the device of the present invention may be applied to a V-type six-cylinder engine constructed such that a first cylinder group having a first cylinder, a third cylinder, and a fifth cylinder arrayed in line in the stated order and a second cylinder group having a second cylinder, a fourth cylinder, and a sixth cylinder arrayed in line in the stated order are arranged to have a predetermined bank angle, and that the combustions are performed in an order of the first cylinder, the second cylinder, the third cylinder, the fourth cylinder, the fifth cylinder, and the sixth cylinder, in which the plurality of fuel injection valves include:

a first fuel injection valve (51*a*) provided to the first cylinder;

a second fuel injection valve (51*b*) provided to the second cylinder;

a third fuel injection valve (51*c*) provided to the third cylinder;

a fourth fuel injection valve (51*d*) provided to the fourth cylinder;

a fifth fuel injection valve (51*e*) provided to the fifth cylinder; and a sixth fuel injection valve (51*f*) provided to the sixth cylinder, and in which the plurality of injection-valve connection pipes include:

a first connection pipe (53*a*) directly connecting the second supply port (56*a*) of the first fuel injection valve and the second supply port of (56*d*) the fourth fuel injection valve;

a second connection pipe (53*b*) directly connecting the second supply port (56*b*) of the second fuel injection valve and the second supply port (56*e*) of the fifth fuel injection valve; and a third connection pipe (53*c*) directly connecting the second supply port (56*c*) of the third fuel injection valve and the second supply port (56*f*) of the sixth fuel injection valve.

Alternatively, the device of the present invention may be applied to a V-type six-cylinder engine constructed such that a first cylinder group having a first cylinder, a third cylinder, and a fifth cylinder arrayed in line in the stated order and a second cylinder group having a second cylinder, a fourth cylinder, and a sixth cylinder arrayed in line in the stated order are arranged to have a predetermined bank angle, and that the combustions are performed in an order of the first cylinder, the second cylinder, the third cylinder, the fourth cylinder, the fifth cylinder, and the sixth cylinder, in which the plurality of fuel injection valves include:

- a first fuel injection valve (51*a*) provided to the first cylinder;
- a second fuel injection valve (51*b*) provided to the second cylinder;
- a third fuel injection valve (51*c*) provided to the third cylinder;
- a fourth fuel injection valve (51*d*) provided to the fourth cylinder;
- a fifth fuel injection valve (51*e*) provided to the fifth cylinder; and
- a sixth fuel injection valve (51*f*) provided to the sixth cylinder, and in which the plurality of injection-valve connection pipes include:

- a first connection pipe (63*a*) directly connecting the second supply port (56*a*) of the first fuel injection valve and the second supply port (56*c*) of the third fuel injection valve;
- a second connection pipe (63*b*) directly connecting the second supply port (56*b*) of the second fuel injection valve and the second supply port (56*e*) of the fifth fuel injection valve; and
- a third connection pipe (63*c*) directly connecting the second supply port (56*d*) of the fourth fuel injection valve and the second supply port (56*f*) of the sixth fuel injection valve.

In any of the above-mentioned embodiments (configurations), each of the plurality of injection-valve connection pipes directly connects the second supply ports of the pair of fuel injection valves provided to the pair of cylinders, which are non-contiguous in the order of combustions. Thus, it is possible to suppress the influence of the fuel pressure fluctuation caused along with the fuel injection from a certain fuel injection valve on the fuel injection from another fuel injection valve connected to the fuel injection valve by the injection-valve connection pipe.

In the above description, the terms and/or reference symbols used in embodiments described later are enclosed in parentheses and assigned to the components of the present invention corresponding to the embodiments for easier understanding of the present invention. However, the constituent elements of the present invention are not limited to the embodiments defined by the terms and/or reference symbols. Other objects, other features, and accompanying advantages of the present invention are easily understandable from the description of the embodiments of the present invention to be given with reference to the following drawings.

DETAILED DESCRIPTION OF THE PREFERRED EMBODIMENTS

Now, description is given of a fuel injection device for an internal combustion engine according to each of embodiments of the present invention with reference to the drawings.

First Embodiment

Figure 1:
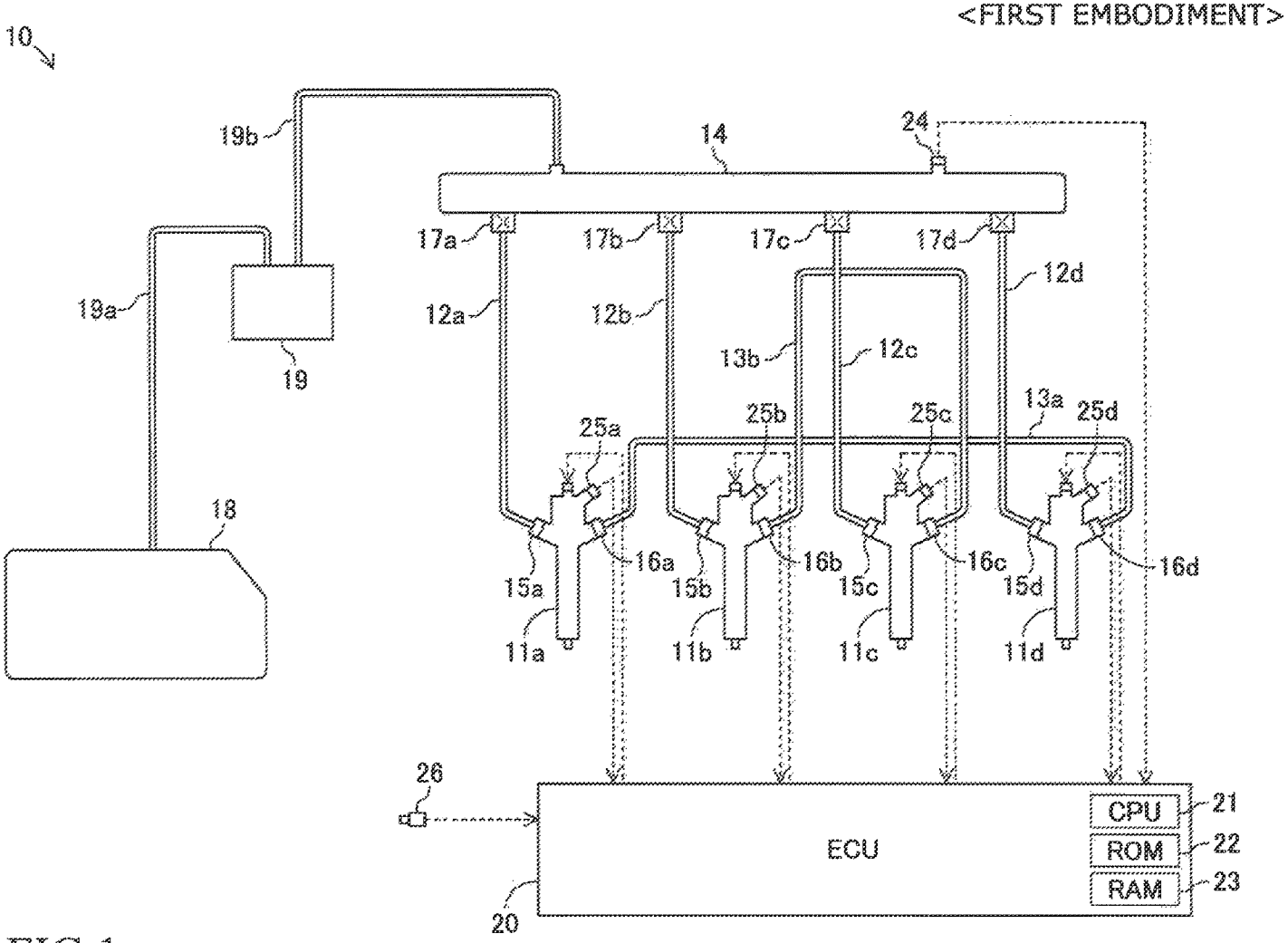
FIG. 1 is a schematic diagram of a fuel injection device for an internal combustion engine (first device) according to a first embodiment of the present invention.

FIG. 1 is a schematic illustration of a fuel injection device 10 for an internal combustion engine according to a first embodiment of the present invention (hereinafter also referred to as "first device"). The fuel injection device 10 is applied to an in-line four-cylinder, four-stroke cycle, and compression ignition diesel engine (not shown) (hereinafter also referred to simply as "engine").

The fuel injection device 10 includes a first fuel injection valve 11*a* to a fourth fuel injection valve 11*d*, a first fuel supply pipe 12*a* to a fourth fuel supply pipe 12*d*, a first injection-valve connection pipe 13*a* and a second injection-valve connection pipe 13*b*, a common rail 14, and a first orifice 17*a* to a fourth orifice 17*d*.

The first fuel injection valve 11*a* to the fourth fuel injection valve 11*d* are provided to the four cylinders (not shown) (first cylinder to fourth cylinder) of the engine, respectively. The first cylinder to the fourth cylinder are arrayed in line in the stated order. Thus, the first fuel injection valve 11*a* to the fourth fuel injection valve 11*d* are arrayed in line in the stated order.

The lengths of the first fuel supply pipe 12*a* to the fourth fuel supply pipe 12*d* are equal to each other. The channel sectional areas of the first fuel supply pipe 12*a* to the fourth fuel supply pipe 12*d* are uniform and equal to each other.

The lengths of the first injection-valve connection pipe 13*a* and the second injection-valve connection pipe 13*b* are equal to each other. The channel sectional areas of the first injection-valve connection pipe 13*a* and the second injection-valve connection pipe 13*b* are uniform and equal to each other.

The first fuel injection valve 11*a* has a first supply port 15*a* and a second supply port 16*a*. The first supply port 15*a* and the second supply port 16*a* communicate to each other at the inside of the first fuel injection valve 11*a*. When the first fuel injection valve 11*a* is opened, fuel supplied through the first supply port 15*a* and the second supply port 16*a* is injected into the first cylinder.

The second fuel injection valve 11*b* has a first supply port 15*b* and a second supply port 16*b*. The first supply port 15*b* and the second supply port 16*b* communicate to each other at the inside of the second fuel injection valve 11*b*. When the second fuel injection valve 11*b* is opened, fuel supplied through the first supply port 15*b* and the second supply port 16*b* is injected into the second cylinder.

The third fuel injection valve 11*c* has a first supply port 15*c* and a second supply port 16*c*. The first supply port 15*c* and the second supply port 16*c* communicate to each other at the inside of the third fuel injection valve 11*c*. When the third fuel injection valve 11*e* is opened, fuel supplied through the first supply port 15*c* and the second supply port 16*c* is injected into the third cylinder.

The fourth fuel injection valve 11*d* has a first supply port 15*d* and a second supply port 16*d*. The first supply port 15*d* and the second supply port 16*d* communicate to each other at the inside of the fourth fuel injection valve 11*d*. When the fourth fuel injection valve 11*d* is opened, fuel supplied through the first supply port 15*d* and the second supply port 16*d* is Injected into the fourth cylinder.

One end of each of the first fuel supply pipe 12*a* to the fourth fuel supply pipe 12*d* is connected to the common rail 14. The first orifice 17*a* to the fourth orifice 17*d* are interposed between the first fuel supply pipe 12*a* to the fourth fuel supply pipe 12*d* and the common rail 14, respectively. Each of the first orifice 17*a* to the fourth orifice 17*d* is provided for the purpose of preventing a pressure change (fluctuation) of the fuel in a corresponding one of the first fuel supply pipe 12*a* to the fourth fuel supply pipe 12*d* from propagating to the fuel in the common rail 14 to cause a pressure fluctuation of the fuel in the common rail 14.

The other end of the first fuel supply pipe 12*a* is connected to the first supply port 15*a* of the first fuel injection valve 11*a*, whereas one end of the first injection-valve connection pipe 13*a* is connected to the second supply port 16*a* of the first fuel injection valve 11*a*. The other end of the second fuel supply pipe 12*b* is connected to the first supply port 15*b* of the second fuel injection valve 11*b*, whereas one end of the second injection-valve connection pipe 13*b* is connected to the second supply port 16*b* of the second fuel injection valve 11*b*.

The other end of the third fuel supply pipe 12*c* is connected to the first supply port 15*c* of the third fuel injection valve 11*c*, whereas the other end of the second injection-valve connection pipe 13*b* is connected to the second supply port 16*c* of the third fuel injection valve 11*c*. The other end of the fourth fuel supply pipe 12*d* is connected to the first supply port 15*d* of the fourth fuel injection valve 11*d*, whereas the other end of the first injection-valve connection pipe 13*a* is connected to the second supply port 16*d* of the fourth fuel injection valve 11*d*.

Thus, the fuel is supplied from the common rail 14 to the first fuel injection valve 11*a* through the first fuel supply pipe 12*a*, and is also supplied from the common rail 14 to the first fuel injection valve 11*a* through the fourth fuel supply pipe 12*d*, the fourth fuel injection valve 11*d*, and the first injection-valve connection pipe 13*a*. Similarly, the fuel is supplied from the common rail 14 to the second fuel injection valve 11*b* through the second fuel supply pipe 12*b*, and is also supplied from the common rail 14 to the second fuel injection valve 11*b* through the third fuel supply pipe 12*c*, the third fuel injection valve 11*c*, and the second injection-valve connection pipe 13*b*.

The fuel is supplied from the common rail 14 to the third fuel injection valve 11*c* through the third fuel supply pipe 12*c*, and is also supplied from the common rail 14 to the third fuel injection valve 11*c* through the second fuel supply pipe 12*b*, the second fuel injection valve 11*b*, and the second injection-valve connection pipe 13*b*. The fuel is supplied from the common rail 14 to the fourth fuel injection valve 11*d* through the fourth fuel supply pipe 12*d*, and is also supplied from the common rail 14 to the fourth fuel injection valve 11*d* through the first fuel supply pipe 12*a*, the first fuel injection valve 11*a*, and the first injection-valve connection pipe 13*a*.

The fuel injection device 10 further includes a fuel tank 18, a fuel supply pump 19, a low-pressure pipe 19*a*, a high-pressure pipe 19*b*, and an ECU 20.

The fuel tank 18 stores the fuel (light oil) of the engine. The fuel supply pump 19 draws up the fuel in the fuel tank 18 through the low-pressure pipe 19*a*, and feeds the fuel under pressure to the common rail 14 through the high-pressure pipe 19*b*. Thus, the common rail 14 accumulates the fuel pressurized by the fuel supply pump 19. The fuel supply pump 19 is actuated by a drive shaft (not shown) interlocking with a crankshaft of the engine.

The ECU 20 is an electronic control unit, and includes a CPU 21, a ROM 22, and a RAM 23. The CPU 21 sequentially executes a predetermined program (routine) to, for example, read data, perform numerical calculation, and output calculation results. The ROM 22 stores, for example, the program to be executed by the CPU 21 and lookup tables (maps). The RAM 23 stores the data temporarily.

The ECU 20 is connected to a rail pressure sensor 24, a first injection-valve fuel pressure sensor 25*a* to a fourth injection-valve fuel pressure sensor 25*d*, and a crank angle sensor 26 to receive signals from those sensors.

The rail pressure sensor 24 detects a pressure of the fuel in the common rail 14 (rail pressure) to output a signal indicating a rail pressure Pa.

The first injection-valve fuel pressure sensor 25*a* outputs a signal indicating a first injection-valve fuel pressure Pi1, which is a pressure of the fuel supplied to the first fuel injection valve 11*a* through the first supply port 15*a* and the second supply port 16*a* (that is, a fuel injection pressure).

The second injection-valve fuel pressure sensor 25*b* outputs a signal indicating a second injection-valve fuel pressure Pi2, which is a pressure of the fuel supplied to the second fuel injection valve 11*b* through the first supply port 15*b* and the second supply port 16*b*.

The third injection-valve fuel pressure sensor 25*c* outputs a signal indicating a third injection-valve fuel pressure Pi3, which is a pressure of the fuel supplied to the third fuel injection valve 11*c* through the first supply port 15*c* and the second supply port 16*c*.

The fourth injection-valve fuel pressure sensor 25*d* outputs a signal indicating a fourth injection-valve fuel pressure Pi4, which is a pressure of the fuel supplied to the fourth fuel injection valve 11*d* through the first supply port 15*d* and the second supply port 16*d*.

The crank angle sensor 26 generates a pulse for each rotation of the crankshaft of the engine by a given angle. The ECU 20 detects an engine rotation speed NE based on the pulse from the crank angle sensor 26. Further, the ECU 20 acquires a crank angle CA of a specific cylinder provided to the engine based on the pulse from the crank angle sensor 26 and a pulse from a cam position sensor (not shown).

The ECU 20 determines, for example, a target rail pressure Ptgt, a fuel injection amount, and a fuel injection timing for each cycle of the engine depending on the engine rotation speed NE, a required torque of the engine, a temperature of an exhaust gas purification catalyst provided to the engine, and other parameters.

The ECU 20 controls the fuel supply pump 19 so that the rail pressure Pa becomes equal to the target rail pressure Ptgt. In addition, when any one of the first fuel injection valve 11*a* to the fourth fuel injection valve 11*d* has reached the fuel injection timing, the ECU 20 transmits a signal for opening the fuel injection valve so that the fuel is injected from the fuel injection valve.

Figure 2:
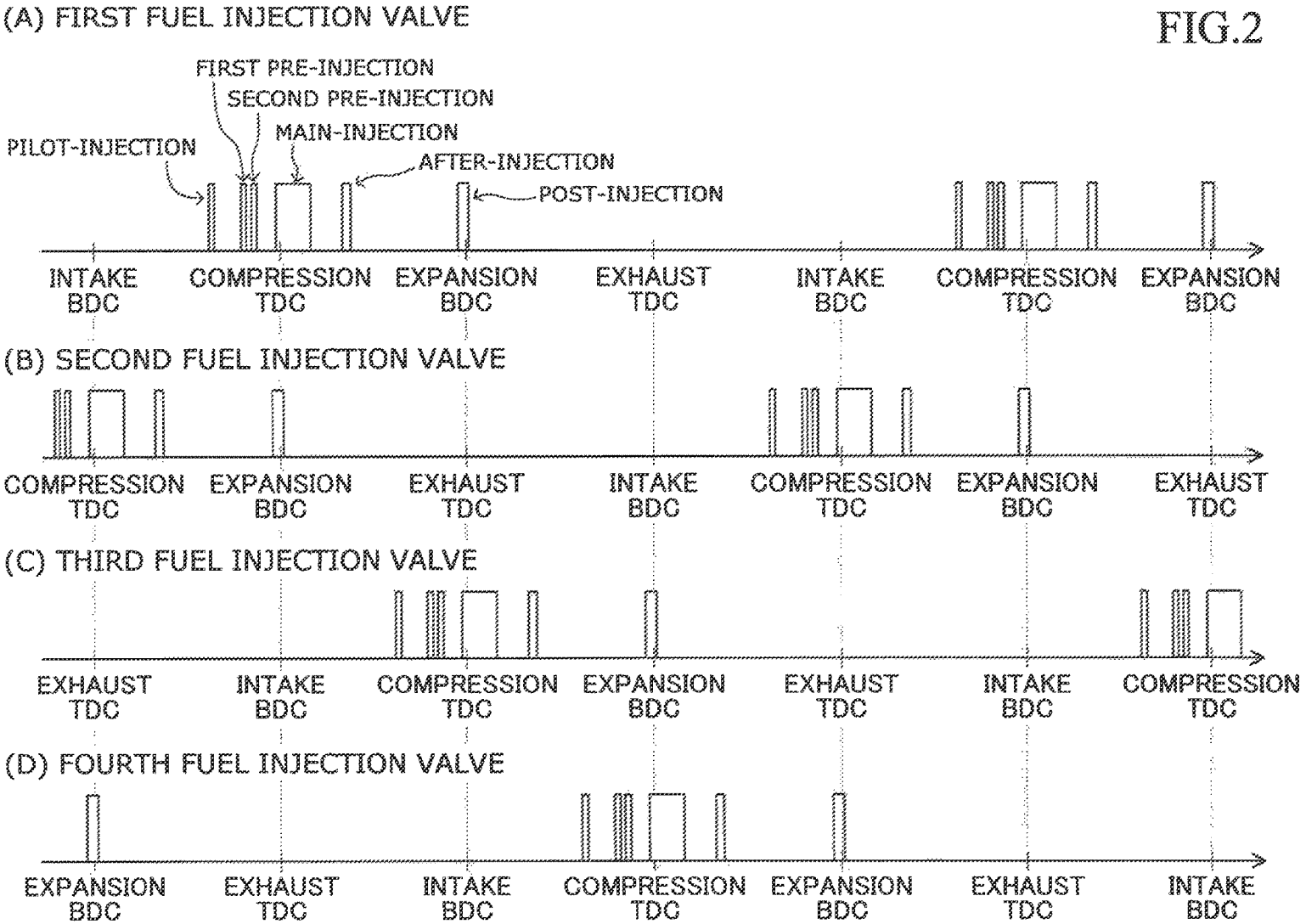
FIG. 2 is a time chart for illustrating fuel injection timings of fuel injection valves provided to the first device.

FIG. 2 is an illustration of examples of the fuel injection timings of the first fuel injection valve 11*a* to the fourth fuel injection valve 11*d*. Each of the first fuel injection valve 11*a* to the fourth fuel injection valve 11*d* performs pilot injection, first pre-injection, second pre-injection, main injection, after-injection, and post-injection for each cycle. When the temperature of the exhaust gas purification catalyst is sufficiently high, the after-injection and/or the post-injection are omitted.

As understood from FIG. 2, the ECU 20 performs the fuel injection in an order of the first fuel injection valve 11*a*, the third fuel injection valve 11*c*, the fourth fuel injection valve 11*d*, and the second fuel injection valve 11*b*. In other words, the engine is constructed such that the combustions are performed in an order of the first cylinder, the third cylinder, the fourth cylinder, and the second cylinder.

(Influence of Fuel Pressure Fluctuation in Fuel Injection Valve having Injected Fuel on Fuel Injection Amount and its Correction)

Now, influence of a fuel pressure fluctuation in the fuel injection valve having injected the fuel on the fuel injection amount is described prior to description of actions and effects of the first device.

Now, focus is placed on the first fuel injection valve 11*e*. When the first fuel injection valve 11*a* is closed (when the fuel injection is not performed), the fuel is fed under pressure to the first fuel injection valve 11*a* through the first fuel supply pipe 12*a* and the first injection-valve connection pipe 13*a*, thereby maintaining a state in which the first injection-valve fuel pressure Pi1 is substantially equal to the rail pressure Pa. When the fuel is injected from the first fuel injection valve 11*a*, however, the first injection-valve fuel pressure Pi1 is decreased temporarily, and is increased afterwards. As a result, a fluctuation (fuel pressure fluctuation) occurs in such a manner that the first injection-valve fuel pressure Pi1 is increased and decreased repeatedly.

When the fuel is injected from the first fuel injection valve 11*a* again under the fluctuation of the first injection-valve fuel pressure Pi1, the amount of fuel injected in actuality may be changed depending on the first injection-valve fuel pressure Pi1 at the time of fuel injection. That is, even under the same fuel injection period (open period), when the fuel is injected at a high first injection-valve fuel pressure Pi1, the amount of fuel injected in actuality becomes larger than in a case where the fuel is injected at a low first injection-valve fuel pressure Pi1.

Therefore, when further fuel injection (second-stage injection) is performed after the fuel injection (first-stage injection) for the same cycle, the ECU 20 adjusts a fuel injection period of the second-stage injection. Specifically, the ECU 20 acquires (predicts) an estimated value of the first injection-valve fuel pressure Pi1 at the start of second-stage injection by applying pressure parameters (that is, an injection period of the first-stage injection, a period from the end of first-stage injection to the start of second-stage injection, the first injection-valve fuel pressure Pi1 at the start of first-stage injection, and other parameters) to a lookup table stored in advance which defines the relation between the first injection-valve fuel pressure Pi1 at the start of second-stage injection and the pressure parameters. For convenience, this lookup table is also referred to as "fuel injection period adjustment map". When the predicted first injection-valve fuel pressure Pi1 at the start of second-stage injection is low, the ECU 20 sets the injection period of the second-stage injection to become longer than in a case where the first injection-valve fuel pressure Pi1 is high.

As described above, the channel sectional areas and the lengths of the first fuel supply pipe 12*a* to the fourth fuel supply pipe 12*d* are equal to each other, and the channel sectional areas and the lengths of the first injection-valve connection pipe 13*a* and the second injection-valve connection pipe 13*b* are equal to each other. Therefore, characteristics of the fluctuations of the first injection-valve fuel pressure Pi1 to the fourth injection-valve fuel pressure Pi4, which are caused along with the fuel injection from the respective injection valves (pressure change with respect to time), are similar to each other.

Figure 3:
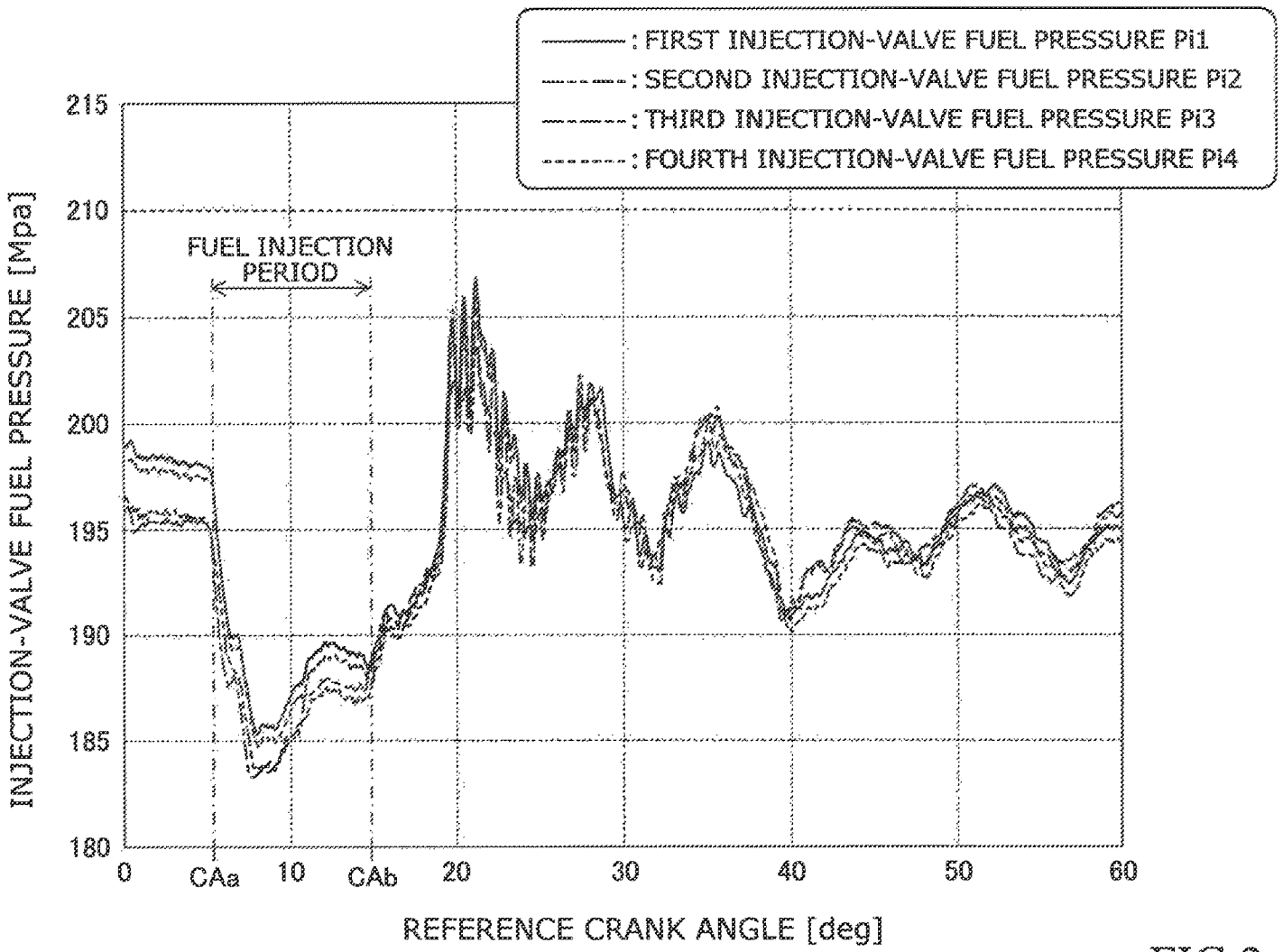
FIG. 3 is a graph for showing changes of injection-valve fuel pressures of the fuel injection valves provided to the first device.

Specifically, FIG. 3 is a graph for showing an example of the characteristics of the fluctuations of the first injection-valve fuel pressure Pi1 to the fourth injection-valve fuel pressure Pi4. In the graph of FIG. 3, the crank angle CA on the horizontal axis is adjusted so that the fuel injection start timing of each of the first fuel injection valve 11*a* to the fourth fuel injection valve 11*d* becomes a timing corresponding to a crank angle CAa of each cylinder. As understood from FIG. 3, the characteristics of the fluctuations of the first injection-valve fuel pressure Pi1 to the fourth injection-valve fuel pressure Pi4 are similar to each other at a crank angle CAb at the end of fuel injection or subsequent crank angles.

Figure 10:
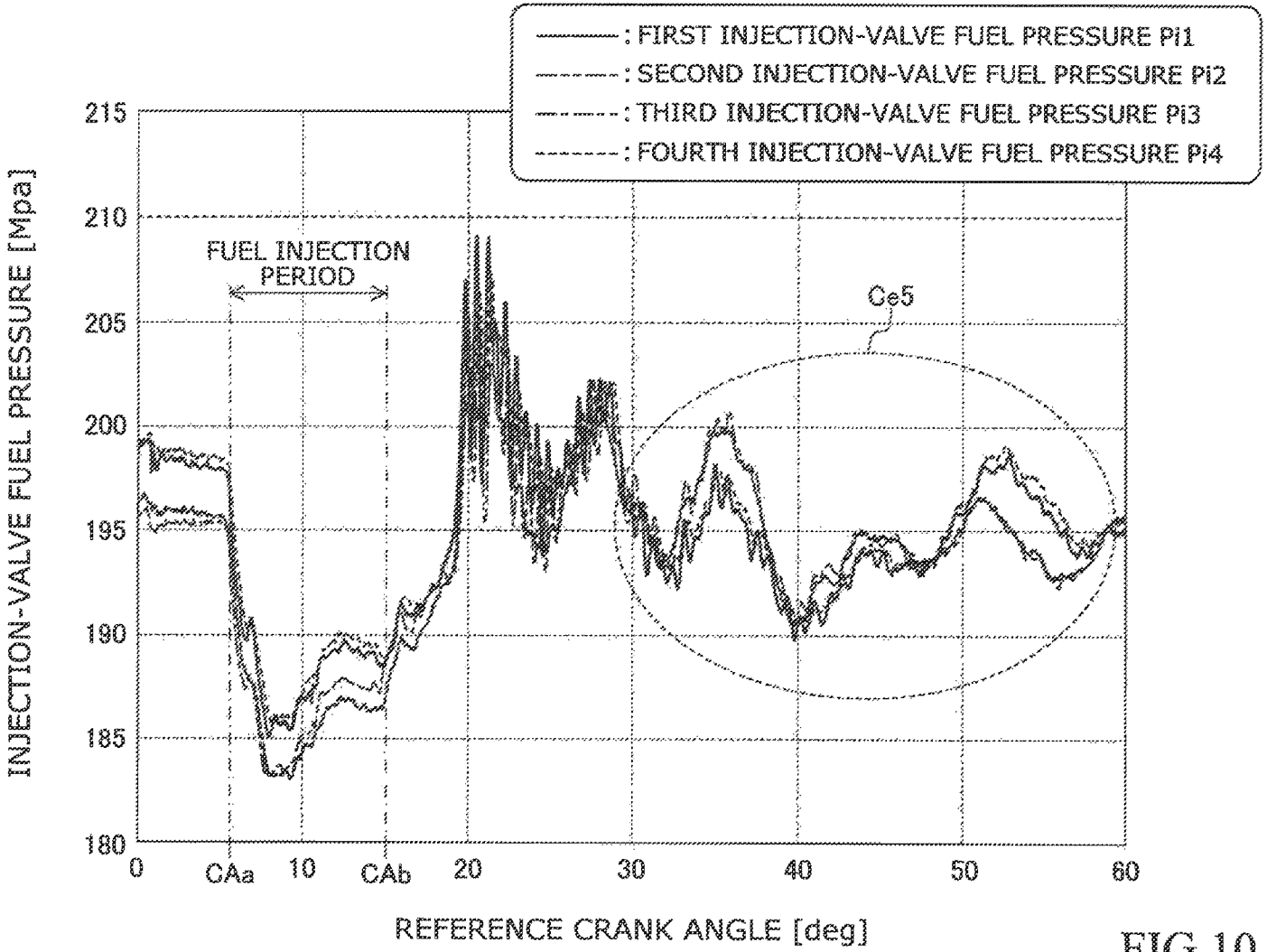
FIG. 10 is a graph for showing changes of injection-valve fuel pressures of fuel injection valves provided to the related-art device.

If the characteristics of the fluctuations of the first injection-valve fuel pressure Pi1 to the fourth injection-valve fuel pressure Pi4 are significantly different from each other (see FIG. 10), the ECU 20 needs to store fuel injection period adjustment maps separately for the first injection-valve fuel pressure Pi1 to the fourth injection-valve fuel pressure Pi4. However, the characteristics of the fluctuations of the first fuel injection valve 11*a* to the fourth fuel injection valve 11*d* are similar to each other, and hence the ECU 20 does not need to store the fuel injection period adjustment maps for the respective fuel injection valves. That is, the ECU 20 may refer to a common fuel injection period adjustment map when estimating the first injection-valve fuel pressure Pi1 to the fourth injection-valve fuel pressure Pi4. In other words, according to the first device, there is no need to prepare the fuel injection period adjustment maps for the respective fuel injection valves, thereby being capable of reducing the number of adaptation steps greatly. Further, there is no need to store the fuel injection period adjustment maps in the ROM 22 for the respective fuel injection valves, thereby being capable of adopting a ROM 22 that is small in storage capacity by an amount corresponding to the respective fuel injection period adjustment maps.

(Influence of Fuel Pressure Fluctuation Caused by Fuel Injection from Certain Fuel Injection Valve on Other Fuel Injection Valve)

Next, description is given of influence of a fuel pressure fluctuation caused by fuel injection from a certain fuel injection valve on "fuel injection from another fuel injection valve". As described above, the first fuel injection valve 11*a* and the fourth fuel injection valve 11*d* are connected to each other by the first injection-valve connection pipe 13*a*. Therefore, the fluctuation of the first injection-valve fuel pressure Pi1 which is caused along with the fuel injection from the first fuel injection valve 11*a*, propagates to the fourth fuel injection valve 11*d* through the first injection-valve connection pipe 13*a*. That is, the fluctuation of the fourth injection-valve fuel pressure Pi4 is caused by the fuel injection from the first fuel injection valve 11*a*.

Meanwhile, the combustions of the engine are performed in an order of the first cylinder, the third cylinder, the fourth cylinder, and the second cylinder. In other words, the third fuel injection valve 11*c* is a fuel injection valve that performs the fuel injection subsequently to the first fuel injection valve 11*a*, and the fourth fuel injection valve 11*d* performs the fuel injection subsequently to the third fuel injection valve 11*c*.

Thus, a certain length of time is taken since the end of fuel injection from the first fuel injection valve lie until the start of fuel injection from the fourth fuel injection valve 11*d* for a certain cycle. As a result, at the start of fuel injection from the fourth fuel injection valve 11*d*, the fluctuation of the fourth injection-valve fuel pressure Pi4, which is caused along with the fuel injection from the first fuel injection valve 11*a*, is mitigated. Therefore, there is no such phenomenon that the amount of fuel injected from the fourth fuel injection valve 11*d* becomes significantly different from the expected amount.

Similarly, the fluctuation of the first injection-valve fuel pressure Pi1 is caused along with the fuel injection from the fourth fuel injection valve 11*d*. However, the second fuel injection valve 11*b* is a fuel injection valve that performs the fuel injection subsequently to the fourth fuel injection valve 11*d*, and the first fuel injection valve 11*a* performs the fuel injection subsequently to the second fuel injection valve 11*b*. Thus, at the time of fuel injection from the first fuel injection valve 11*a*, the fluctuation of the first injection-valve fuel pressure Pi1, which is caused along with the fuel injection from the fourth fuel injection valve 11*d*, is mitigated. Therefore, there is no such phenomenon that the amount of fuel injected from the first fuel injection valve 11*a* becomes significantly different from the expected amount.

Further, the second fuel injection valve 11*b* and the third fuel injection valve 11*c* are connected to each other by the second injection-valve connection pipe 13*b*. Therefore, the third injection-valve fuel pressure Pi3 fluctuates due to the fuel injection from the second fuel injection valve 11*b*, and the second injection-valve fuel pressure Pi2 fluctuates due to the fuel injection from the third fuel injection valve 11*c*. However, the first fuel injection valve 11*a* is a fuel injection valve that performs the fuel injection subsequently to the second fuel injection valve 11*b*, and the third fuel injection valve 11*c* is a fuel injection valve that performs the fuel injection subsequently to the first fuel injection valve 11*a*.

Thus, at the time of fuel injection from the third fuel injection valve 11*c*, the fluctuation of the third injection-valve fuel pressure Pi3, which is caused along with the fuel injection from the second fuel injection valve 11*b*, is mitigated. Therefore, there is no such phenomenon that the amount of fuel injected from the third fuel injection valve 11*c* becomes significantly different from the expected amount.

Similarly, the fourth fuel injection valve 11*d* is a fuel injection valve that performs the fuel injection subsequently to the third fuel injection valve 11*c*, and the second fuel injection valve 11*b* is a fuel injection valve that performs the fuel injection subsequently to the fourth fuel injection valve 11*d*. Thus, at the time of fuel injection from the second fuel injection valve 11*b*, the fluctuation of the second injection-valve fuel pressure Pi2, which is caused along with the fuel injection from the third fuel injection valve 11*c*, is mitigated. Therefore, there is no such phenomenon that the amount of fuel injected from the second fuel injection valve 11*b* becomes significantly different from the expected amount.

Figure 4:
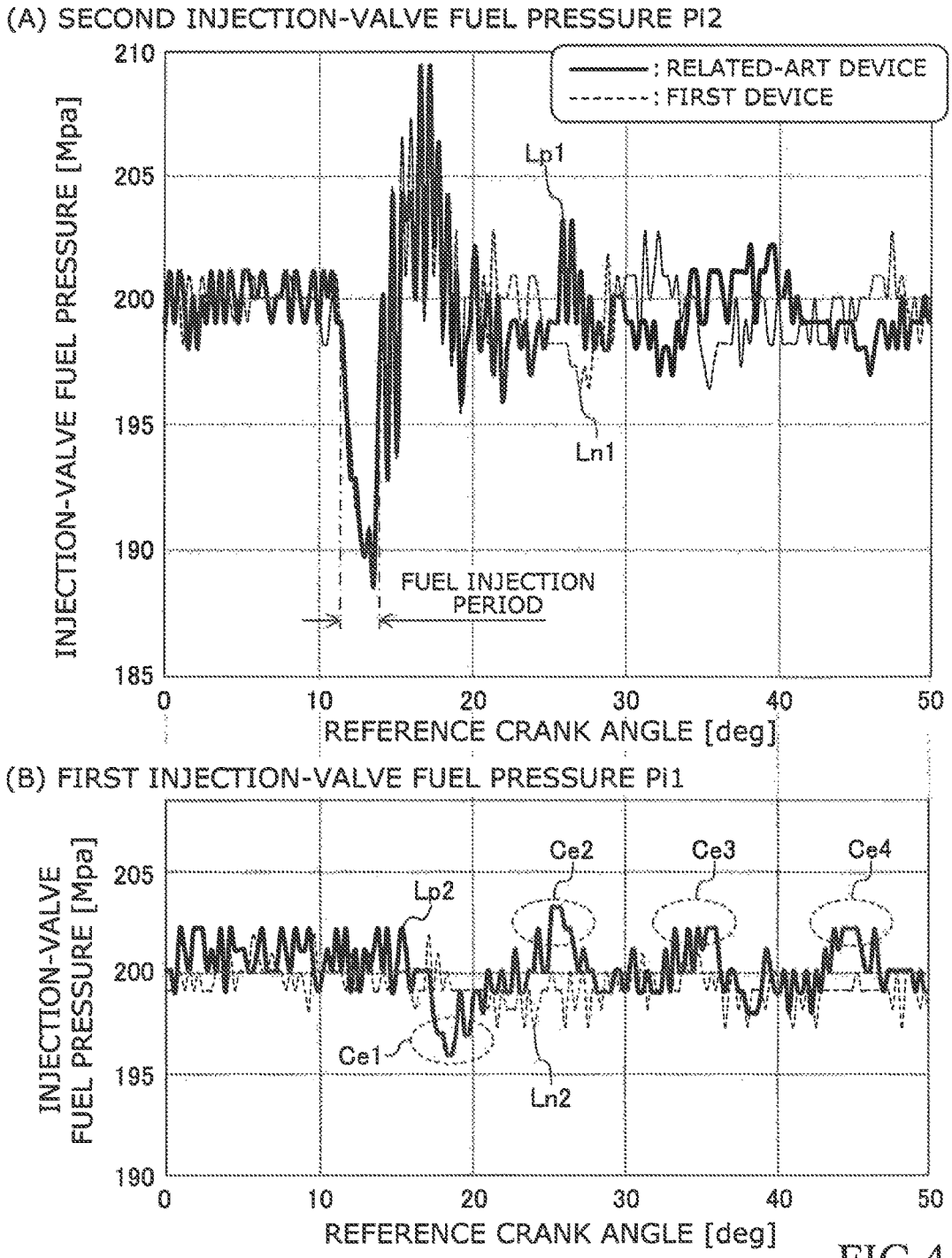
FIG. 4 is a graph for showing changes of injection-valve fuel pressures of second fuel injection valves and first fuel injection valves, which are provided to a related-art device and the first device, respectively, along with fuel injection from the second fuel injection valves.

FIG. 4 is a graph for showing that the fluctuation of the injection-valve fuel pressure is suppressed as described above according to the first device. More specifically, the broken line Ln1 of FIG. 4 indicates an example of a change of the second injection-valve fuel pressure Pi2 at the time of fuel injection from the second fuel injection valve 11*b*. In addition, the broken line Ln2 of FIG. 4 indicates an example of a change of the first injection-valve fuel pressure Pi1 at that time. Note that, a phase difference of 180° is present between the crank angle CA of the first cylinder and the crank angle CA of the second cylinder, but the injection-valve fuel pressures at the same reference crank angle (for example, at a compression top dead center) are shown in the graph of FIG. 4.

As understood from FIG. 4, the amplitude of the fluctuation indicated by the broken line Ln2 is reduced as compared to the solid line Lp2 according to the related-art device. That is, in the first device, the fluctuation of the first injection-valve fuel pressure Pi1, which is caused by the fuel injection from the second fuel injection valve 11*b*, is suppressed as compared to the related-art device.

As described above, according to the first device, it is possible to suppress the influence of the fuel pressure fluctuation caused along with the fuel injection from any one of the first fuel injection valve 11*a* to the fourth fuel injection valve 11*d* on the fuel injection from another fuel injection valve connected to the fuel injection valve by the first injection-valve connection pipe 13*a* or the second injection-valve connection pipe 13*b*.

In addition, the characteristics of the fluctuations of the first injection-valve fuel pressure Pi1 to the fourth injection-valve fuel pressure Pi4 are similar to each other. Therefore, there is no need to adapt different fuel injection period adjustment maps to the first fuel injection valve 11*a* to the fourth fuel injection valve 11*d*, respectively, and hence the ECU 20 only needs to store a single fuel injection period adjustment map. Thus, according to the first device, it is possible to reduce the number of adaptation steps for generating the fuel injection period adjustment map.

Second Embodiment

Next, description is given of a fuel injection device 30 for an internal combustion engine according to a second embodiment of the present invention (hereinafter also referred to as "second device"). The first device is applied to the in-line four-cylinder engine. In contrast, the second device is different from the first device only in that the second device is applied to an in-line six-cylinder engine (hereinafter also referred to simply as "engine"). Thus, the difference is mainly described below.

Figure 5:
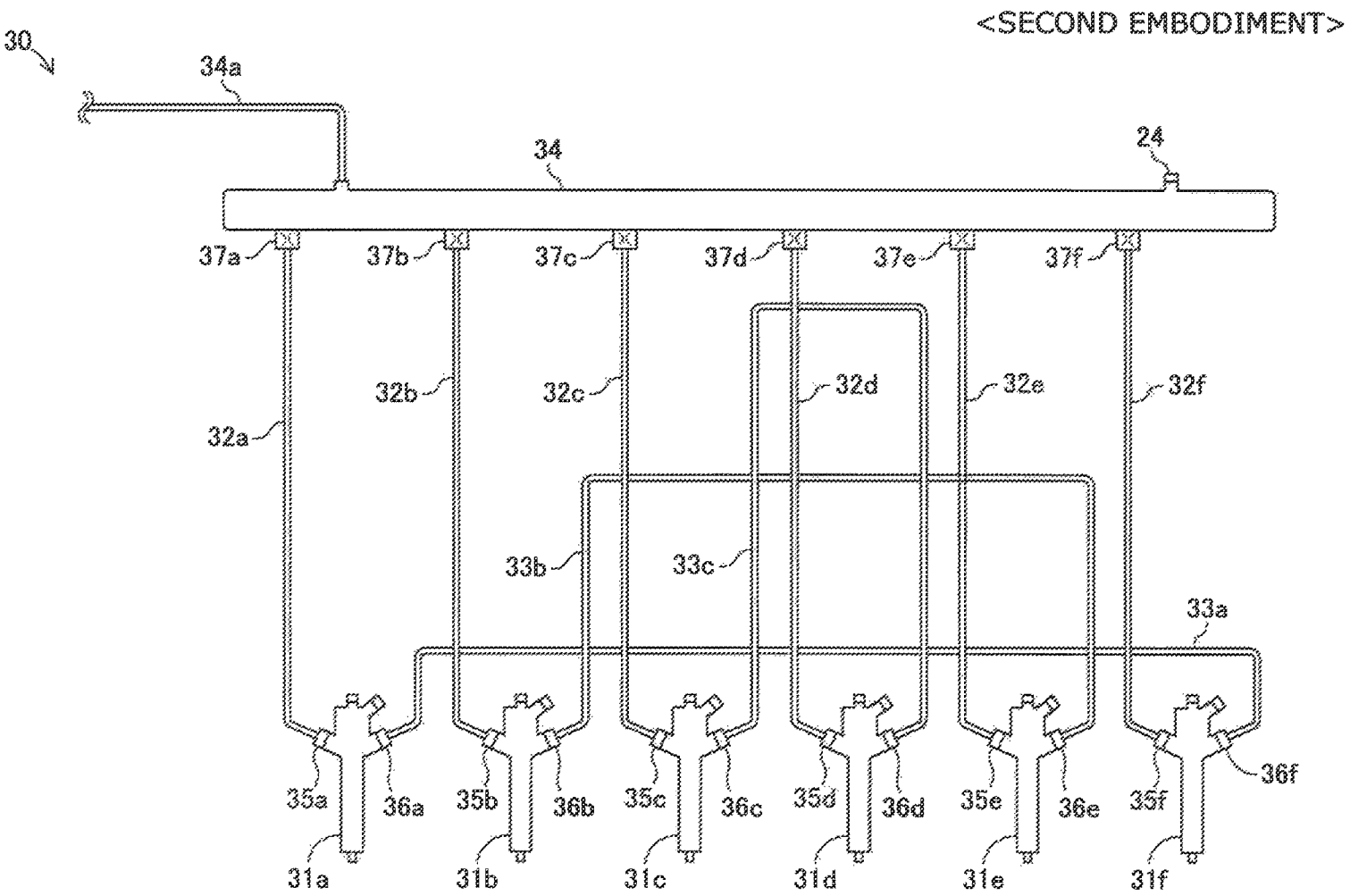
FIG. 5 is a schematic diagram of a fuel injection device for an internal combustion engine according to a second embodiment of the present invention.
Figure 6:
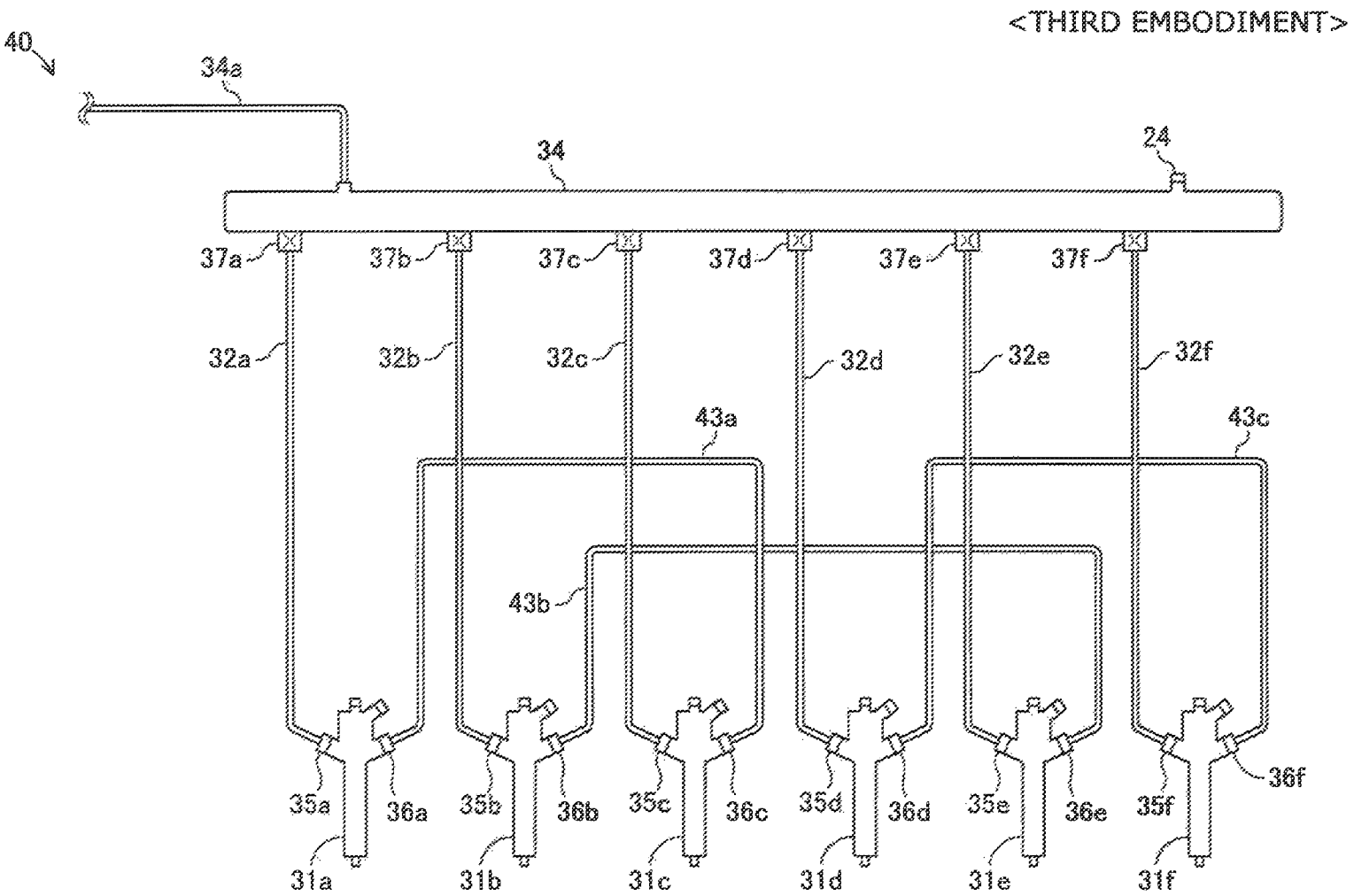
FIG. 6 is a schematic diagram of a fuel injection device for an internal combustion engine according to a third embodiment of the present invention.

FIG. 5 is a schematic illustration of the fuel injection device 30. The fuel injection device 30 includes a first fuel injection valve 31*a* to a sixth fuel injection valve 31*f*, a first fuel supply pipe 32*a* to a sixth fuel supply pipe 32*f*, a first injection-valve connection pipe 33*a* to a third injection-valve connection pipe 33*c*, a common rail 34, and a first orifice 37*a* to a sixth orifice 37*f*.

Each of the first fuel injection valve 31*a* to the sixth fuel injection valve 31*f* has a configuration similar to that of the fuel injection valve according to the first embodiment (that is, each of the first fuel injection valve 11*a* to the fourth fuel injection valve 11*d*). The first fuel injection valve 31*a* to the sixth fuel injection valve 31*f* are provided to the six cylinders (not shown) (first cylinder to sixth cylinder) of the engine, respectively. The first cylinder to the sixth cylinder are arrayed in line in the stated order. Thus, the first fuel injection valve 31*a* to the sixth fuel injection valve 31*f* are arrayed in line in the stated order.

The lengths of the first fuel supply pipe 32*a* to the sixth fuel supply pipe 32*f* are equal to each other. The channel sectional areas of the first fuel supply pipe 32*a* to the sixth fuel supply pipe 32*f* are uniform and equal to each other.

The lengths of the first injection-valve connection pipe 33*a* to the third injection-valve connection pipe 33*c* are equal to each other. The channel sectional areas of the first injection-valve connection pipe 33*a* to the third injection-valve connection pipe 33*c* are uniform and equal to each other.

The first fuel supply pipe 32*a* connects the common rail 34 and a first supply port 35*a* of the first fuel injection valve 31*a*. The second fuel supply pipe 32*b* connects the common rail 34 and a first supply port 35*b* of the second fuel injection valve 31*b*. The third fuel supply pipe 32*c* connects the common rail 34 and a first supply port 35*c* of the third fuel injection valve 31*c*.

The fourth fuel supply pipe 32*d* connects the common rail 34 and a first supply port 35*d* of the fourth fuel injection valve 31*d*. The fifth fuel supply pipe 32*e* connects the common rail 34 and a first supply port 35*e* of the fifth fuel injection valve 31*e*. The sixth fuel supply pipe 32*f* connects the common rail 34 and a first supply port 351 of the sixth fuel injection valve 31*f*.

The first orifice 37*a* to the sixth orifice 37*f* are interposed between the first fuel supply pipe 32*a* to the sixth fuel supply pipe 32*f* and the common rail 34, respectively. The fuel is fed under pressure from a fuel pump (not shown) to the common rail 34 through a high-pressure pipe 34*a*.

The first injection-valve connection pipe 33*a* connects a second supply port 36*a* of the first fuel injection valve 31*a* and a second supply port 36*f* of the sixth fuel injection valve 31*f*. The second injection-valve connection pipe 33*b* connects a second supply port 36*b* of the second fuel injection valve 31*b* and a second supply port 36*e* of the fifth fuel injection valve 31*e*. The third injection-valve connection pipe 33*c* connects a second supply port 36*c* of the third fuel injection valve 31*c* and a second supply port 36*d* of the fourth fuel injection valve 31*d*.

As described above, also in the second device, the channel sectional areas and the lengths of the plurality of fuel supply pipes are equal to each other, and the channel sectional areas and the lengths of the plurality of injection-valve connection pipes are equal to each other. Therefore, the characteristics of fuel pressure fluctuations, which are caused along with the fuel injection from the first fuel injection valve 31*a* to the sixth fuel injection valve 31*f*, are similar to each other. Thus, when further fuel injection (second-stage injection) is performed after the fuel injection (first-stage injection) for the same cycle, an ECU (not shown) of the fuel injection device 30 acquires (predicts) the injection-valve fuel pressure at the start of second-stage injection based on a common fuel injection period adjustment map. In other words, the ECU stores a single fuel injection period adjustment map, but does not store a plurality of fuel injection period adjustment maps corresponding to the first fuel injection valve 31*a* to the sixth fuel injection valve 31*f*, respectively.

Meanwhile, the ECU of the fuel injection device 30 performs the fuel injection in an order of the first fuel injection valve 31*a*, the fifth fuel injection valve 31*e*, the third fuel injection valve 31*c*, the sixth fuel injection valve 31*f*, the second fuel injection valve 31*b*, and the fourth fuel injection valve 31*d*. That is, the engine is constructed such that the combustions are performed in an order of the first cylinder, the fifth cylinder, the third cylinder, the sixth cylinder, the second cylinder, and the fourth cylinder.

In other words, a pair of cylinders to which a pair of fuel injection valves connected by each of the first injection-valve connection pipe 33*a* to the third injection-valve connection pipe 33*c* are provided are non-contiguous in the order of combustions. Thus, a certain length of time is taken since the end of fuel injection from one of the pair of fuel injection valves until the start of fuel injection from the other one of the pair of fuel injection valves. As a result, the fuel pressure fluctuation caused along with the fuel injection from one of the pair of fuel injection valves is mitigated at the start of fuel injection from the other one of the pair of fuel injection valves.

As described above, according to the second device, there is no need to adapt the plurality of fuel injection period adjustment maps, thereby being capable of reducing the number of adaptation steps for generating the fuel injection period adjustment map. In addition, according to the second device, it is possible to suppress the influence of the fuel pressure fluctuation caused along with the fuel injection from any one of the first fuel injection valve 31*a* to the sixth fuel injection valve 31*f* on the fuel injection from another fuel injection valve connected by any one of the first injection-valve connection pipe 33*a* to the third injection-valve connection pipe 33*c*.

Third Embodiment

Next, description is given of a fuel injection device 40 for an internal combustion engine according to a third embodiment of the present invention (hereinafter also referred to as "third device"). In the second device, the first fuel injection valve and the sixth fuel injection valve are connected by the injection-valve connection pipe, the second fuel injection valve and the fifth fuel injection valve are connected by the injection-valve connection pipe, and the third fuel injection valve and the fourth fuel injection valve are connected by the injection-valve connection pipe.

In contrast, the third device is different from the second device only in that the first fuel injection valve and the third fuel injection valve are connected by the injection-valve connection pipe, the second fuel injection valve and the fifth fuel injection valve are connected by the injection-valve connection pipe, and the fourth fuel injection valve and the sixth fuel injection valve are connected by the injection-valve connection pipe. Thus, the difference is mainly described below.

Figure 8:
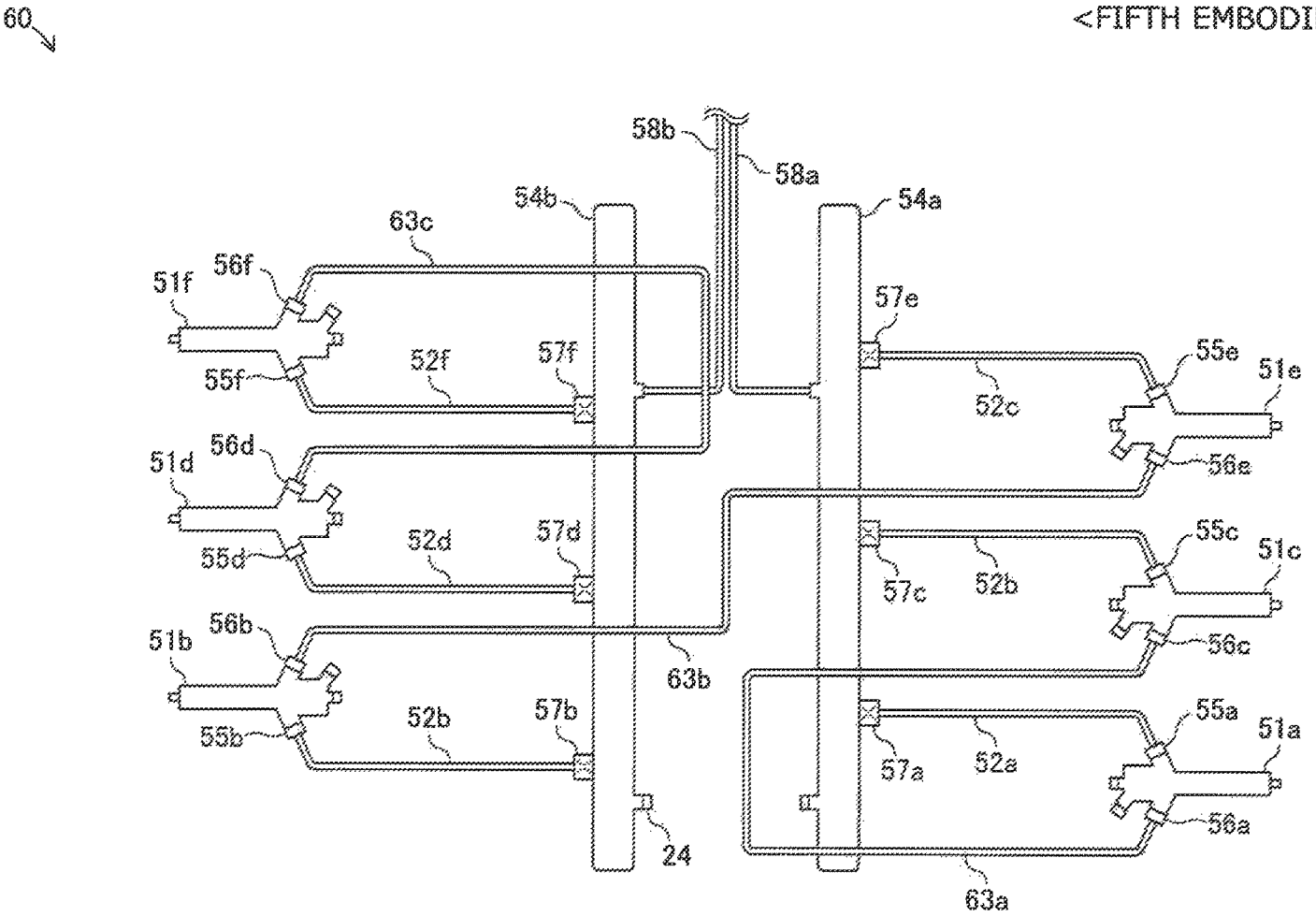
FIG. 8 is a schematic diagram of a fuel injection device for an internal combustion engine according to a fifth embodiment of the present invention.
Figure 9:
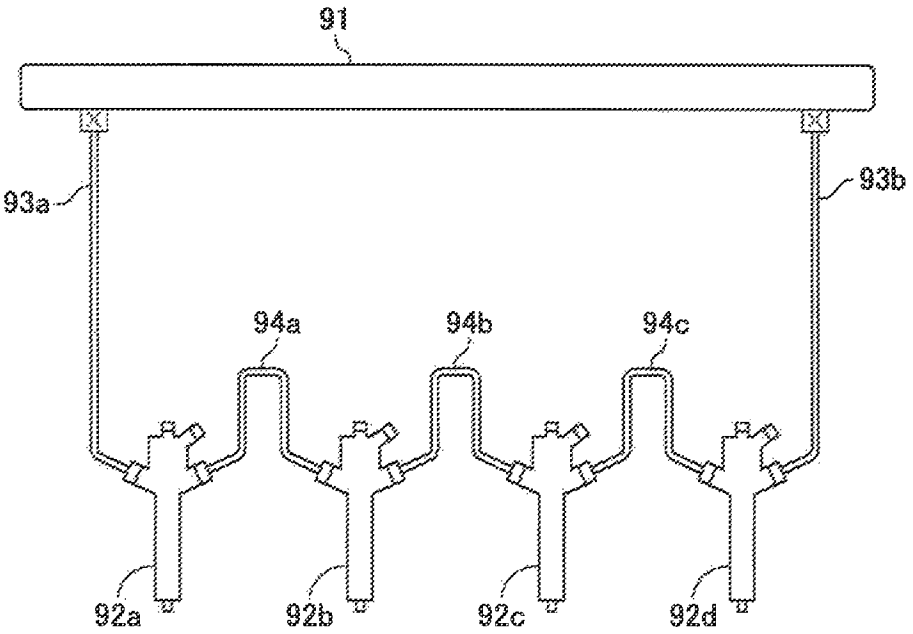
FIG. 9 is a schematic diagram of the related-art device.

FIG. 8 is a schematic illustration of the fuel injection device 40. The fuel injection device 40 includes the first fuel injection valve 31*a* to the sixth fuel injection valve 31*f*, the first fuel supply pipe 32*a* to the sixth fuel supply pipe 32*f*, a first injection-valve connection pipe 43*a* to a third injection-valve connection pipe 43*c*, the common rail 34, and the first orifice 37*a* to the sixth orifice 37*f*.

The first injection-valve connection pipe 43*a* connects the second supply port 36*a* of the first fuel injection valve 31*a* and the second supply port 36*c* of the third fuel injection valve 31*c*. The second injection-valve connection pipe 43*b* connects the second supply port 36*b* of the second fuel injection valve 31*b* and the second supply port 36*e* of the fifth fuel injection valve 31*e*. The third injection-valve connection pipe 43*c* connects the second supply port 36*d* of the fourth fuel injection valve 31*d* and the second supply port 36*f* of the sixth fuel injection valve 31*f*.

The lengths of the first fuel supply pipe 32*a* to the sixth fuel supply pipe 32*f* are equal to each other. The channel sectional areas of the first fuel supply pipe 32*a* to the sixth fuel supply pipe 321 are uniform and equal to each other.

The lengths of the first injection-valve connection pipe 43*a* to the third injection-valve connection pipe 43*c* are equal to each other. The channel sectional areas of the first injection-valve connection pipe 43*a* to the third injection-valve connection pipe 43*c* are uniform and equal to each other.

Therefore, the characteristics of fuel pressure fluctuations, which are caused along with the fuel injection from the first fuel injection valve 31*a* to the sixth fuel injection valve 31*f*, are similar to each other. Thus, when further fuel injection (second-stage injection) is performed after the fuel injection (first-stage injection) for the same cycle, an ECU (not shown) of the fuel injection device 40 acquires (predicts) the injection-valve fuel pressure at the start of second-stage injection based on a common fuel injection period adjustment map.

Meanwhile, the ECU of the fuel injection device 40 performs the fuel injection in an order of the first fuel injection valve 31*a*, the fourth fuel injection valve 31*d*, the second fuel injection valve 31*b*, the third fuel Injection valve 31*c*, the sixth fuel injection valve 31*f*, and the fifth fuel injection valve 31*e*. That is, the engine is constructed such that the combustions are performed in an order of the first cylinder, the fourth cylinder, the second cylinder, the third cylinder, the sixth cylinder, and the fifth cylinder.

In other words, a pair of cylinders to which a pair of fuel injection valves connected by each of the first injection-valve connection pipe 43*a* to the third injection-valve connection pipe 43*c* are provided are non-contiguous in the order of combustions. Thus, a certain length of time is taken since the end of fuel injection from one of the pair of fuel injection valves until the start of fuel injection from the other one of the pair of fuel injection valves. As a result, the fuel pressure fluctuation caused along with the fuel injection from one of the pair of fuel injection valves is mitigated at the start of fuel injection from the other one of the pair of fuel injection valves.

As described above, according to the third device, there is no need to adapt the plurality of fuel injection period adjustment maps, and hence it is only necessary to store a single common fuel injection period adjustment map. Thus, it is possible to reduce the number of adaptation steps for generating the fuel injection period adjustment map. In addition, according to the third device, it is possible to suppress the influence of the fuel pressure fluctuation caused along with the fuel injection from any one of the first fuel injection valve 31*a* to the sixth fuel injection valve 31*f* on the fuel injection from another fuel injection valve connected by any one of the first injection-valve connection pipe 43*a* to the third injection-valve connection pipe 43*c*.

Fourth Embodiment

Next, description is given of a fuel injection device 50 for an internal combustion engine according to a fourth embodiment of the present invention (hereinafter also referred to as "fourth device"). The second device is applied to the in-line six-cylinder engine. In contrast, the fourth device is different from the second device only in that the fourth device is applied to a V-type six-cylinder engine (hereinafter also referred to simply as "engine"). Thus, the difference is mainly described below.

Figure 7:
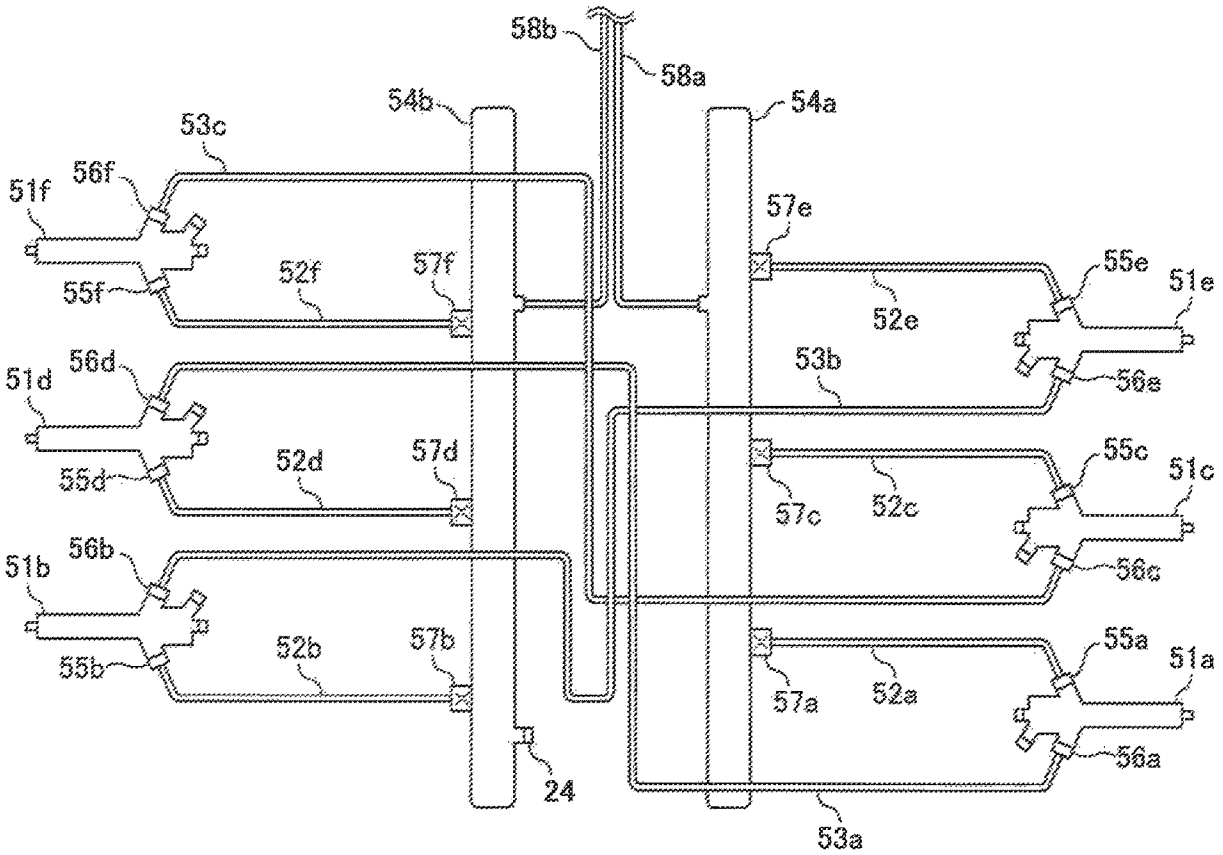
FIG. 7 is a schematic diagram of a fuel injection device for an internal combustion engine according to a fourth embodiment of the present invention.

FIG. 7 is a schematic illustration of the fuel injection device 50. The fuel injection device 50 includes a first fuel injection valve 51*a* to a sixth fuel injection valve 51*f*, a first fuel supply pipe 52*a* to a sixth fuel supply pipe 52*f*, a first injection-valve connection pipe 53*a* to a third injection-valve connection pipe 53*c*, a first common rail 54*a*, a second common rail 54*b*, and a first orifice 57*a* to a sixth orifice 57*f*.

Each of the first fuel injection valve 51*a* to the sixth fuel injection valve 51*f* has a configuration similar to that of the fuel injection valve according to the first embodiment (that is, each of the first fuel injection valve 11*a* to the fourth fuel injection valve 11*d*). The first fuel injection valve 51*a* to the sixth fuel injection valve 51*f* are provided to the six cylinders (not shown) (first cylinder to sixth cylinder) of the engine, respectively.

A first bank (first cylinder group) of the engine is constructed of the first cylinder, the third cylinder, and the fifth cylinder, whereas a second bank (second cylinder group) of the engine is constructed of the second cylinder, the fourth cylinder, and the sixth cylinder. The first bank and the second bank are opposed to each other at a predetermined bank angle.

The first cylinder, the third cylinder, and the fifth cylinder are arrayed in line in the stated order, and hence the first fuel injection valve 51*a*, the third fuel injection valve 51*c*, and the fifth fuel injection valve 51*e* are arrayed in line in the stated order. Meanwhile, the second cylinder, the fourth cylinder, and the sixth cylinder are arrayed in line in the stated order, and hence the second fuel injection valve 51*b*, the fourth fuel injection valve 51*d*, and the sixth fuel injection valve 51*f* are arrayed in line in the stated order.

The first fuel supply pipe 52*a* connects the first common rail 54*a* and a first supply port 55*a* of the first fuel injection valve 51*a*. The second fuel supply pipe 52*b* connects the second common rail 54*b* and a first supply port 55*b* of the second fuel injection valve 51*b*. The third fuel supply pipe 52*c* connects the first common rail 54*a* and a first supply port 55*c* of the third fuel injection valve 51*c*.

The fourth fuel supply pipe 52*d* connects the second common rail 54*b* and a first supply port 55*d* of the fourth fuel injection valve 51*d*. The fifth fuel supply pipe 52*e* connects the first common rail 54*a* and a first supply port 55*e* of the fifth fuel injection valve 51*e*. The sixth fuel supply pipe 52*f* connects the second common rail 54*b* and a first supply port 55*f* of the sixth fuel injection valve 51*f*.

The first orifice 57*a*, the third orifice 57*c*, and the fifth orifice 57*e* are interposed between the first fuel supply pipe 52*a*, the third fuel supply pipe 52*c*, and the fifth fuel supply pipe 52*e* and the first common rail 54*a*, respectively. The second orifice 57*b*, the fourth orifice 57*d*, and the sixth orifice 57*f* are interposed between the second fuel supply pipe 52*b*, the fourth fuel supply pipe 52*d*, and the sixth fuel supply pipe 52*f* and the second common rail 54*b*, respectively.

The fuel is fed under pressure from a fuel pump (not shown) to the first common rail 54*a* through a high-pressure pipe 58*a*. The fuel is fed under pressure from the fuel pump to the second common rail 54*b* through a high-pressure pipe 58*b*.

The first injection-valve connection pipe 53*a* connects a second supply port 56*a* of the first fuel injection valve 51*a* and a second supply port 56*d* of the fourth fuel injection valve 51*d*. The second injection-valve connection pipe 53*b* connects a second supply port 56*b* of the second fuel injection valve 51*b* and a second supply port 56*e* of the fifth fuel injection valve 51*e*. The third injection-valve connection pipe 53*c* connects a second supply port 56*c* of the third fuel injection valve 51*c* and a second supply port 56*f* of the sixth fuel injection valve 51*f*.

The lengths of the first fuel supply pipe 52*a* to the sixth fuel supply pipe 52*f* are equal to each other. The channel sectional areas of the first fuel supply pipe 52*a* to the sixth fuel supply pipe 52*f* are uniform and equal to each other.

The lengths of the first injection-valve connection pipe 53*a* to the third injection-valve connection pipe 53*c* are equal to each other. The channel sectional areas of the first injection-valve connection pipe 53*a* to the third injection-valve connection pipe 53*c* are uniform and equal to each other.

Therefore, the characteristics of fuel pressure fluctuations, which are caused along with the fuel injection from the first fuel injection valve 51*a* to the sixth fuel injection valve 51*f*, are similar to each other. Thus, when further fuel injection (second-stage injection) is performed after the fuel injection (first-stage injection) for the same cycle, an ECU (not shown) of the fuel injection device 50 acquires (predicts) the injection-valve fuel pressure at the start of second-stage injection based on a common fuel injection period adjustment map.

Meanwhile, the ECU of the fuel injection device 50 performs the fuel injection in an order of the first fuel injection valve 51*a*, the second fuel injection valve 51*b*, the third fuel injection valve 51*c*, the fourth fuel injection valve 51*d*, the fifth fuel injection valve 51*e*, and the sixth fuel injection valve 51*f*. That is, the engine is constructed such that the combustions are performed in an order of the first cylinder, the second cylinder, the third cylinder, the fourth cylinder, the fifth cylinder, and the sixth cylinder.

In other words, a pair of cylinders to which a pair of fuel injection valves connected by each of the first injection-valve connection pipe 53*a* to the third injection-valve connection pipe 53*c* are provided are non-contiguous in the order of combustions. Thus, a certain length of time is taken since the end of fuel injection from one of the pair of fuel injection valves until the start of fuel injection from the other one of the pair of fuel injection valves. As a result, the fuel pressure fluctuation caused along with the fuel injection from one of the pair of fuel injection valves is mitigated at the start of fuel injection from the other one of the pair of fuel injection valves.

As described above, according to the fourth device, there is no need to adapt the plurality of fuel injection period adjustment maps, and hence it is only necessary to store a single common fuel injection period adjustment map. Thus, it is possible to reduce the number of adaptation steps for generating the fuel injection period adjustment map. In addition, according to the fourth device, it is possible to suppress the influence of the fuel pressure fluctuation caused along with the fuel injection from any one of the first fuel injection valve 51*a* to the sixth fuel injection valve 51*f* on the fuel injection from another fuel injection valve connected by any one of the first injection-valve connection pipe 53*a* to the third injection-valve connection pipe 53*c*.

Fifth Embodiment

Next, description is given of a fuel injection device 60 for an internal combustion engine according to a fifth embodiment of the present invention (hereinafter also referred to as "fifth device"). In the fourth device, the first fuel injection valve and the fourth fuel injection valve are connected by the injection-valve connection pipe, the second fuel injection valve and the fifth fuel injection valve are connected by the injection-valve connection pipe, and the third fuel injection valve and the sixth fuel injection valve are connected by the injection-valve connection pipe.

In contrast, the fifth device is different from the fourth device only in that the first fuel injection valve and the third fuel injection valve are connected by the injection-valve connection pipe, the second fuel injection valve and the fifth fuel injection valve are connected by the injection-valve connection pipe, and the fourth fuel injection valve and the sixth fuel injection valve are connected by the injection-valve connection pipe. Thus, the difference is mainly described.

FIG. 8 is a schematic illustration of the fuel injection device 60. The fuel injection device 60 includes the first fuel injection valve 51*a* to the sixth fuel injection valve 51*f*, the first fuel supply pipe 52*a* to the sixth fuel supply pipe 52*f*, a first injection-valve connection pipe 63*a* to a third injection-valve connection pipe 63*c*, the first common rail 54*a*, the second common rail 54*b*, and the first orifice 57*a* to the sixth orifice 57*f*.

The first injection-valve connection pipe 63*a* connects the second supply port 56*a* of the first fuel injection valve 51*a* and the second supply port 56*c* of the third fuel injection valve 51*c*. The second injection-valve connection pipe 63*b* connects the second supply port 56*b* of the second fuel injection valve 51*b* and the second supply port 56*e* of the fifth fuel injection valve 51*e*. The third injection-valve connection pipe 63*c* connects the second supply port 56*d* of the fourth fuel injection valve 51*d* and the second supply port 56*f* of the sixth fuel injection valve 51*f*.

The lengths of the first fuel supply pipe 52*a* to the sixth fuel supply pipe 52*f* are equal to each other. The channel sectional areas of the first fuel supply pipe 52*a* to the sixth fuel supply pipe 52*f* are uniform and equal to each other.

The lengths of the first injection-valve connection pipe 63*a* to the third injection-valve connection pipe 63*c* are equal to each other. The channel sectional areas of the first injection-valve connection pipe 63*a* to the third injection-valve connection pipe 63*c* are uniform and equal to each other.

Therefore, the characteristics of fuel pressure fluctuations, which are caused along with the fuel injection from the first fuel injection valve 51*a* to the sixth fuel injection valve 51*f*, are similar to each other. Thus, when further fuel injection (second-stage injection) is performed after the fuel injection (first-stage injection) for the same cycle, an ECU (not shown) of the fuel injection device 60 acquires (predicts) the injection-valve fuel pressure at the start of second-stage injection based on a common fuel injection period adjustment map.

Meanwhile, the ECU of the fuel injection device 60 performs the fuel injection in an order of the first fuel injection valve 51*a*, the second fuel injection valve 51*b*, the third fuel injection valve 51*c*, the fourth fuel injection valve 51*d*, the fifth fuel injection valve 51*e*, and the sixth fuel injection valve 51*f*. That is, the engine is constructed such that the combustions are performed in an order of the first cylinder, the second cylinder, the third cylinder, the fourth cylinder, the fifth cylinder, and the sixth cylinder.

In other words, a pair of cylinders to which a pair of fuel injection valves connected by each of the first injection-valve connection pipe 63*a* to the third injection-valve connection pipe 63*c* are provided are non-contiguous in the order of combustions. Thus, a certain length of time is taken since the end of fuel injection from one of the pair of fuel injection valves until the start of fuel injection from the other one of the pair of fuel injection valves. As a result, the fuel pressure fluctuation caused along with the fuel injection from one of the pair of fuel injection valves is mitigated at the start of fuel injection from the other one of the pair of fuel injection valves.

As described above, according to the fifth device, there is no need to adapt the plurality of fuel injection period adjustment maps, and hence it is only necessary to store a single common fuel injection period adjustment map. Thus, it is possible to reduce the number of adaptation steps for generating the fuel injection period adjustment map. In addition, according to the fifth device, it is possible to suppress the influence of the fuel pressure fluctuation caused along with the fuel injection from any one of the first fuel injection valve 51*a* to the sixth fuel injection valve 51*f* on the fuel injection from another fuel injection valve connected by any one of the first injection-valve connection pipe 63*a* to the third injection-valve connection pipe 63*c*.

In the above, the fuel injection device for an internal combustion engine according to each of the embodiments of the present invention is described, but the present invention is not limited to the above-mentioned embodiments, and various modifications may be made without departing from the object of the present invention. For example, the fuel injection device according to each of the embodiments is applied to the in-line four-cylinder engine, the in-line six-cylinder engine, or the V-type six-cylinder engine. However, the fuel injection device may be applied to an engine with an even number of cylinders including eight or more cylinders. Alternatively, the fuel injection device may be applied to a horizontally-opposed engine (for example, a horizontally-opposed six-cylinder engine).

In addition, the fuel injection device according to each of the embodiments includes the fuel supply pipes and the injection-valve connection pipes having uniform channel sectional areas. However, the fuel supply pipes and/or the injection-valve connection pipes may have non-uniform channel sectional areas. When the channel sectional areas of the fuel supply pipes are not uniform, the fuel supply pipes are constructed such that the channel sectional areas of portions equidistant from the ends on one side (for example, the ends on the first supply port side) become equal to each other. When the channel sectional areas of the injection-valve connection pipes are not uniform, the injection-valve connection pipes are constructed such that the channel sectional areas of portions equidistant from the ends on one side become equal to each other.

What is claimed is:

1. A fuel injection device for an internal combustion engine, which is applied to a multi-cylinder internal combustion engine with an even number of cylinders including four or more cylinders, the fuel injection device comprising:

a common rail to which pressurized fuel is to be supplied;

a plurality of fuel injection valves;

a plurality of fuel supply pipes; and a plurality of injection-valve connection pipes, each of said plurality of fuel injection valves having a first supply port and a second supply port that communicates to the first supply port, and being configured to inject the pressurized fuel, which is supplied to each of the first supply port and the second supply port, to a corresponding one of the even number of cylinders, each of said plurality of fuel supply pipes directly connecting the first supply port of the each of said plurality of fuel injection valves and said common rail, each of said plurality of injection-valve connection pipes directly connecting the second supply ports of a pair of said plurality of fuel injection valves provided to a pair of the cylinders, which are non-contiguous in an order of combustions.

2. A fuel injection device for an internal combustion engine according to claim 1, wherein channel sectional areas and lengths of said plurality of fuel supply pipes are equal to each other, and wherein channel sectional areas and lengths of said plurality of injection-valve connection pipes are equal to each other.

3. A fuel injection device for an internal combustion engine according to claim 1, wherein said internal combustion engine comprises an in-line four-cylinder engine constructed such that a first cylinder, a second cylinder, a third cylinder, and a fourth cylinder are arrayed in line in the stated order, and that the combustions are performed in an order of the first cylinder, the third cylinder, the fourth cylinder, and the second cylinder, wherein said plurality of fuel injection valves comprise:

a first fuel injection valve provided to the first cylinder;

a second fuel injection valve provided to the second cylinder;

a third fuel injection valve provided to the third cylinder; and a fourth fuel injection valve provided to the fourth cylinder, and wherein said plurality of injection-valve connection pipes comprise:

a first connection pipe directly connecting the second supply port of the first fuel injection valve and the second supply port of the fourth fuel injection valve; and a second connection pipe directly connecting the second supply port of the second fuel injection valve and the second supply port of the third fuel injection valve.

4. A fuel injection device for an internal combustion engine according to claim 1, wherein said internal combustion engine comprises an in-line six-cylinder engine constructed such that a first cylinder, a second cylinder, a third cylinder, a fourth cylinder, a fifth cylinder, and a sixth cylinder are arrayed in line in the stated order, and that the combustions are performed in an order of the first cylinder, the fifth cylinder, the third cylinder, the sixth cylinder, the second cylinder, and the fourth cylinder, wherein said plurality of fuel injection valves comprise:

a first fuel injection valve provided to the first cylinder;

a second fuel injection valve provided to the second cylinder;

a third fuel injection valve provided to the third cylinder;

a fourth fuel injection valve provided to the fourth cylinder;

a fifth fuel injection valve provided to the fifth cylinder; and a sixth fuel injection valve provided to the sixth cylinder, and wherein said plurality of injection-valve connection pipes comprise:

a first connection pipe directly connecting the second supply port of the first fuel injection valve and the second supply port of the sixth fuel injection valve;

a second connection pipe directly connecting the second supply port of the second fuel injection valve and the second supply port of the fifth fuel injection valve; and a third connection pipe directly connecting the second supply port of the third fuel injection valve and the second supply port of the fourth fuel injection valve.

5. A fuel injection device for an internal combustion engine according to claim 1, wherein said internal combustion engine comprises an in-line six-cylinder engine constructed such that a first cylinder, a second cylinder, a third cylinder, a fourth cylinder, a fifth cylinder, and a sixth cylinder are arrayed in line in the stated order, and that the combustions are performed in an order of the first cylinder, the fourth cylinder, the second cylinder, the third cylinder, the sixth cylinder, and the fifth cylinder, wherein said plurality of fuel injection valves comprise:

a first fuel injection valve provided to the first cylinder;

a second fuel injection valve provided to the second cylinder;

a third fuel injection valve provided to the third cylinder;

a fourth fuel injection valve provided to the fourth cylinder;

a fifth fuel injection valve provided to the fifth cylinder; and a sixth fuel injection valve provided to the sixth cylinder, and wherein said plurality of injection-valve connection pipes comprise:

a first connection pipe directly connecting the second supply port of the first fuel injection valve and the second supply port of the third fuel injection valve;

a second connection pipe directly connecting the second supply port of the second fuel injection valve and the second supply port of the fifth fuel injection valve; and a third connection pipe directly connecting the second supply port of the fourth fuel injection valve and the second supply port of the sixth fuel injection valve.

6. A fuel injection device for an internal combustion engine according to claim 1, wherein said internal combustion engine comprises a V-type six-cylinder engine constructed such that a first cylinder group having a first cylinder, a third cylinder, and a fifth cylinder arrayed in line in the stated order and a second cylinder group having a second cylinder, a fourth cylinder, and a sixth cylinder arrayed in line in the stated order are arranged to have a predetermined bank angle, and that the combustions are performed in an order of the first cylinder, the second cylinder, the third cylinder, the fourth cylinder, the fifth cylinder, and the sixth cylinder, wherein said plurality of fuel injection valves comprise:

a first fuel injection valve provided to the first cylinder;

a second fuel injection valve provided to the second cylinder;

a third fuel injection valve provided to the third cylinder;

a fourth fuel injection valve provided to the fourth cylinder;

a fifth fuel injection valve provided to the fifth cylinder; and a sixth fuel injection valve provided to the sixth cylinder, and wherein said plurality of injection-valve connection pipes comprise:

a first connection pipe directly connecting the second supply port of the first fuel injection valve and the second supply port of the fourth fuel injection valve;

a second connection pipe directly connecting the second supply port of the second fuel injection valve and the second supply port of the fifth fuel injection valve; and a third connection pipe directly connecting the second supply port of the third fuel injection valve and the second supply port of the sixth fuel injection valve.

7. A fuel injection device for an internal combustion engine according to claim 1, wherein said internal combustion engine comprises a V-type six-cylinder engine constructed such that a first cylinder group having a first cylinder, a third cylinder, and a fifth cylinder arrayed in line in the stated order and a second cylinder group having a second cylinder, a fourth cylinder, and a sixth cylinder arrayed in line in the stated order are arranged to have a predetermined bank angle, and that the combustions are performed in an order of the first cylinder, the second cylinder, the third cylinder, the fourth cylinder, the fifth cylinder, and the sixth cylinder, wherein said plurality of fuel injection valves comprise:

a first fuel injection valve provided to the first cylinder;

a second fuel injection valve provided to the second cylinder;

a third fuel injection valve provided to the third cylinder;

a fourth fuel injection valve provided to the fourth cylinder;

a fifth fuel injection valve provided to the fifth cylinder; and a sixth fuel injection valve provided to the sixth cylinder, and wherein said plurality of injection-valve connection pipes comprise:

a first connection pipe directly connecting the second supply port of the first fuel injection valve and the second supply port of the third fuel injection valve;

a second connection pipe directly connecting the second supply port of the second fuel injection valve and the second supply port of the fifth fuel injection valve; and a third connection pipe directly connecting the second supply port of the fourth fuel injection valve and the second supply port of the sixth fuel injection valve.

* * * * *